US005725981A

United States Patent [19]

Kato

[11] Patent Number: 5,725,981

[45] Date of Patent: Mar. 10, 1998

[54] METHOD OF FORMING COLOR IMAGES BY ELECTROPHOTOGRAPHIC PROCESS EMPLOYING A PEELABLE TRANSFER LAYER HAVING A STRATIFIED STRUCTURE

[75] Inventor: Eiichi Kato, Shizuoka, Japan

[73] Assignee: Fuji Photo Film Co., Ltd., Kanagawa, Japan

[21] Appl. No.: 692,238

[22] Filed: Aug. 7, 1996

[30] Foreign Application Priority Data

Aug. 9, 1995 [JP] Japan ..... 7-222778

[51] Int. Cl.[6] ..... G03G 13/14

[52] U.S. Cl. ..... 430/47; 430/126

[58] Field of Search ..... 430/45, 47, 126

[56] References Cited

U.S. PATENT DOCUMENTS 5,526,102 6/1996 Kato ..... 430/47

5,582,943 12/1996 Kato et al. ..... 430/66

*Primary Examiner*—John Goodrow

*Attorney, Agent, or Firm*—Sughrue, Mion, Zinn, Macpeak & Seas, PLLC

[57] ABSTRACT

A method of forming a color image by an electrophotographic process comprising forming a peelable transfer layer on a surface of an electrophotographic light-sensitive element, forming a toner image by an electrophotographic process on the transfer layer, heat-transferring the toner image together with the transfer layer onto a receiving material, wherein the transfer layer has a stratified structure composed of a first transfer layer ($T_1$) which is contact with the surface of electrophotographic light-sensitive element and is formed by an electrodeposition coating method using thermoplastic resin grains (AR) each containing a resin (AH) having a glass transition point of from 20° C. to 140° C. or a softening point of from 30° C. to 180° C. and a resin ($AL_1$) having a glass transition point of from −40° C. to 40° C. or a softening point of from 0° C. to 60° C. wherein the glass transition point or softening point of resin (AH) is at least 2° C. higher than that of resin ($AL_1$) and a second transfer layer ($T_2$) provided thereon containing a resin ($AL_2$) having a glass transition point of from −40° C. to 35° C. or a softening point of from 0° C. to 45° C.

The method can provide color images of high accuracy and high quality without color shear in a simple and stable manner. Good color duplicates can be obtained at a low temperature of transfer or a high speed of transfer irrespective of the kind of receiving material. Color duplicates obtained are excellent in retouching property, sealing property and filing property.

21 Claims, 4 Drawing Sheets

METHOD OF FORMING COLOR IMAGES BY ELECTROPHOTOGRAPHIC PROCESS EMPLOYING A PEELABLE TRANSFER LAYER HAVING A STRATIFIED STRUCTURE

FIELD OF THE INVENTION

The present invention relates to a method of forming a color image by an electrophotographic process, and more particularly to a method of forming a color image using an electrophotographic process which repeatedly provides duplicated images of good quality in a stable manner and is applicable to the field of color copy, color print, color proof, color check and the like.

BACKGROUND OF THE INVENTION

Methods of forming color printings, color duplicates or color proofs (proofs for printing) which comprises conducting development with electrophotographic developing agents to form a plurality of overlapping color toner images directly on the surface of electrophotographic light-sensitive element and transferring at once the resulting color images onto a receiving material such as printing paper are known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to printing paper.

In order to solve this problem, a transfer technique in which a non-aqueous solvent is supplied between a light-sensitive element and a receiving material and then transfer is electrostatically performed is described in JP-A-2-272469 (the term "JP-A" as used herein means an "unexamined published Japanese patent application").

Also, a method in which a transparent film is first laminated on the surface of a light-sensitive element, wet type toner images are formed by an electrophotographic process on the film, and then the film bearing the toner images is separated from the light-sensitive element and stuck on plain paper, thereby forming transferred images is described in JP-A-2-115865 and JP-A-2-115866. According to the method, the film to be laminated has suitably a thickness of 9 μm. However, the production and handling of a film having such a thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form overlapping color separation images on a dielectric support releasably provided on the light-sensitive element and the dielectric support bearing the images is transferred to a receiving material is described. Since the imagewise exposure, is performed from the side of substrate for the light-sensitive element according to this method, the substrate is required to be transparent. This is disadvantageous in view of a cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper is described in JP-A-1-112264, JP-A-1-281464 and JP-A-3-11347.

However, in order to employ the light-sensitive element repeatedly in the techniques hitherto known, a special operation is required at the time of transfer or difficulties in the formation of transfer layer are encountered. On the other hand, the method using a light-sensitive element having a transfer layer (or a releasable layer) previously formed thereon is disadvantageous in point of cost since the light-sensitive element used is inevitably thrown.

Moreover, in JP-A-2-265280 a method in which toner images on a light-sensitive layer are transferred onto a primary intermediate transfer medium having high smoothness and then transferred onto a final receiving material is described. Also, a method in which a special transfer medium is used in order to obtain final color images of good quality even when wet type toner is employed is proposed in JP-A-3-243973 and JP-A-4-9087.

It appears that tone images are transferred without being affected by irregularities on the surface of receiving material according to these methods. However, since toner images are first transferred onto the primary intermediate transfer medium and then further transferred onto the final receiving material, a lack of toner image, particularly a lack of fine images such as fine lines and fine letters and unevenness in image density are observed in the resulting color images.

Further, toner images remain on the surfaces of light-sensitive element and primary intermediate transfer medium after the transfer process. Therefore, it is necessary to clean the surfaces of light-sensitive element and primary intermediate transfer medium when they are repeatedly employed. This is disadvantageous in that a device for cleaning must be provided and in that the surfaces of light-sensitive element and primary intermediate transfer medium is damaged by cleaning.

Moreover, in European Patent Publication No. 534, 479A1, a method of forming color images in which a peelable transfer layer comprising a thermoplastic resin is formed on a surface of a light-sensitive element which has releasability, one or more color toner images are formed on the transfer layer by an electrophotographic process and then the toner images are transferred together with the transfer layer onto a receiving material is described. According to the method, the toner images formed from a wet type toner can be wholly transferred without degradation and the light-sensitive element is repeatedly usable, resulting in the reduction of cost.

However, in the method, since a toner image is formed on the transfer layer provided on the light-sensitive element by an electrophotographic process, the transfer layer is requested not to adversely affect electrophotographic characteristics of the light-sensitive element. Further, it is necessary that the toner image formed on the transfer layer sufficiently adhere to the receiving material at the transfer. However, it is difficult to conduct the complete transfer of toner image at all times, since toner image portions and a surface condition of the receiving material influence the adherence.

As described above, conventional color image forming methods using an intermediate transfer medium have problems in that fully satisfactory color images can not be obtained, in that since the property of intermediate medium is changed, it is difficult to maintain stably its performance over a long period of time, when the intermediate medium is repeatedly used, in that disposable materials must be employed to maintain its performance, and in that a special transfer medium is required.

Also, in known color image forming methods providing a transfer layer on a light-sensitive element there is a problem in that it is difficult to obtain color image of high accuracy in a stable manner irrespective of the kind of toner or receiving material.

SUMMARY OF THE INVENTION

The present invention is intended to solve the above-described various problems associated with conventionally known method for forming an electrophotographic color transfer image.

An object of the present invention is to provide a method of forming a color image by an electrophotographic process using a transfer layer which method provides simply and stably a color image of high accuracy and high quality without color shear irrespective of the kind of receiving material to be employed.

Another object of the present invention is to provide a method of forming a color transfer image using an electrophotographic process in which a toner image is wholly transferred together with a transfer layer onto a receiving material even when the transfer layer has a reduced thickness or the transfer conditions are varied for example, when temperature or pressure for transfer is decreased or a transfer speed is increased.

Other objects of the present invention will become apparent from the following description and examples.

It has been found that the above described objects of the present invention are accomplished by a method of forming a color image by an electrophotographic process comprising forming a peelable transfer layer on a surface of an electrophotographic light-sensitive element, forming a toner image by an electrophotographic process on the transfer layer, heat-transferring the toner image together with the transfer layer onto a receiving material, wherein the transfer layer has a stratified structure composed of a first transfer layer ($T_1$) which is contact with the surface of electrophotographic light-sensitive element and is formed by an electrodeposition coating method using thermoplastic resin grains (AR) each containing a resin (AH) having a glass transition point of from 20° C. to 140° C. or a softening point of from 30° C. to 180° C. and a resin ($AL_1$) having a glass transition point of from −40° C. to 40° C. or a softening point of from 0° C. to 60° C. wherein the glass transition point or softening point of resin (AH) is at least 2° C. higher than that of resin ($AL_1$) and a second transfer layer ($T_2$) provided thereon containing a resin ($AL_2$) having a glass transition point of from −40° C. to 35° C. or a softening point of from 0° C. to 45° C.

BRIEF DESCRIPTION OF THE ACCOMPANYING DRAWINGS

Figure 1:
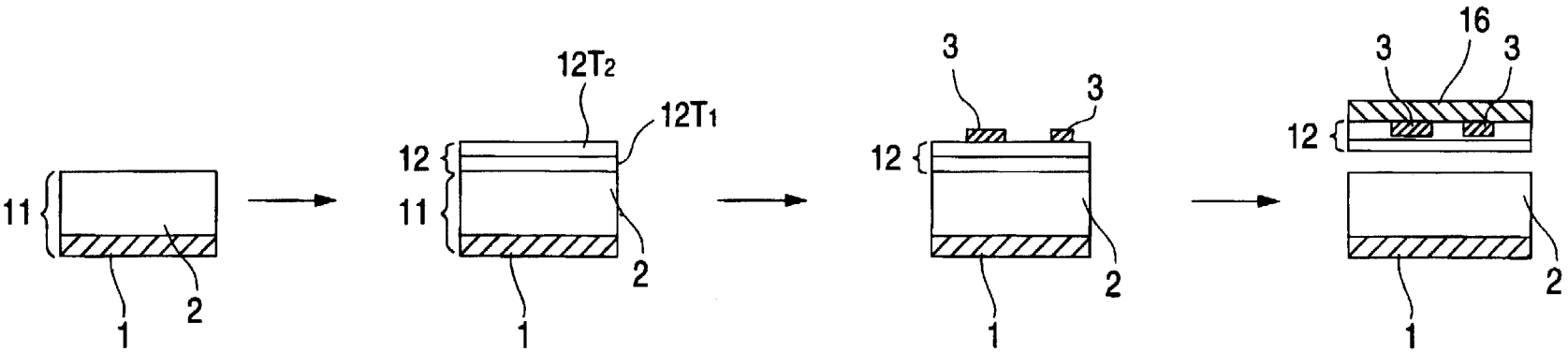
FIG. 1 is a schematic view for explanation of the method according to the present invention.

Explanation of the Symbols:

1 Support
2 Light-sensitive layer
3 Toner image
10 Applying unit for compound (S)
11 Light-sensitive element
12 Transfer layer
12$T_1$ First transfer layer
12$T_2$ Second transfer layer
12*a* Dispersion of thermoplastic resin grain
12*b* Dispersion of thermoplastic resin grain
12*c* Thermoplastic resin
13*a* Electrodeposition unit
13*b* Electrodeposition unit
13*c* Hot-melt coater
14 Liquid developing unit set
14Y Yellow liquid developing unit
14M Magenta liquid developing unit
14C Cyan liquid developing unit
14B Black liquid developing unit
14R Rinsing unit
15 Suction/exhaust unit
15*a* Suction part
15*b* Exhaust part
16 Receiving material
17 Transfer unit to-receiving material
17*a* Heating means
17*b* Backup roller for transfer
17*c* Backup roller for release
18 Corona charger
19 Exposure device
20 Release paper
117 Transfer unit to light-sensitive element
117*b* Heating roller
117*c* Cooling roller

DETAILED DESCRIPTION OF THE INVENTION

The method of forming a color image by an electrophotographic process according to the present invention will be diagrammatically described with reference to FIG. 1 of the accompanying drawings.

As shown in FIG. 1, the method of forming a color image comprises providing a first transfer layer ($T_1$) 12$T_1$ on a surface of an electrophotographic light-sensitive element 11 having at least a support 1 and a light-sensitive layer 2 by an electrodeposition coating method using the thermoplastic resin grains (AR), providing a second transfer layer ($T_2$) 12$T_2$ comprising the thermoplastic resin ($AL_2$) on the first transfer layer ($T_1$) to from a peelable transfer layer 12 having a stratified structure, forming at least one color toner image 3 on the transfer layer 12 by a conventional electrophotographic process, and transferring the toner image 3 together with the transfer layer 12 onto a receiving material 16 to form a color duplicate.

The method of the present invention is characterized in that the transfer layer has a stratified structure and in that the thermoplastic resin grain (AR) containing at least two kinds of the resin (AH) and the resin ($AL_1$) having glass transition points or softening points different from each other by at least 2° C. is employed to form the first transfer layer ($T_1$) provided on the light-sensitive element and the second transfer layer ($T_2$) provided thereon is composed of the Resin ($AL_2$).

It is believed that the synergistic effect of decreased adhesion at the interface between the light-sensitive element and the first transfer layer ($T_1$) and increased adhesion at the interface between the second transfer layer ($T_2$) and a receiving material can be obtained based on the above-described stratified structure of the transfer layer. As a result, transferability of the transfer layer is remarkably improved and an enlarged latitude of transfer (for example, decrease in temperature and/or pressure for transfer and increase in a transfer speed) can be achieved. Consequently, degradation of the electrophotographic characteristics of light-sensitive element is restrained and durability thereof in repeated use is improved since heat and/or pressure applied to the light-sensitive element is decreased. Further, a speed of color image formation increases because a period of time necessary for the transfer step is shortened. Also, the transfer is easily performed irrespective of the kind of receiving material.

Because the toner image is transferred together with the transfer layer, a color duplicate of high accuracy and high quality free from color shear can be obtained in a simple and stable manner.

Moreover, since the surface of light-sensitive element is protected by the transfer layer and is not brought into direct contact with a receiving material, damage of the surface of electrophotographic light-sensitive element is reduced and the light-sensitive element can be employed repeatedly and over a long period of time. Furthermore, by forming each time the transfer layer on the light-sensitive element in an apparatus wherein the electrophotographic process is conducted, the light-sensitive element can be repeatedly employed after the release of transfer layer in the same apparatus. Thus, the method of the present invention can be successively performed without exhausting the light-sensitive element each time.

Now, the transfer layer which can be used in the present invention will be described in greater detail below.

As described above, the transfer layer of the present invention has a stratified structure composed of the first transfer layer ($T_1$) and the second transfer layer ($T_2$). Hereinafter, the first transfer layer ($T_1$) and the second transfer layer ($T_2$) are collectively referred to as a transfer layer (T) sometimes. The transfer layer (T) may be previously provided on the electrophotographic light-sensitive element or formed each time on the light-sensitive element in the apparatus for electrophotographic process.

The transfer layer (T) of the present invention is radiation-transmittive. Specifically, it is a layer capable of transmitting a radiation having a wave length which constitutes at least one part of the spectrally sensitive region of electrophotographic light-sensitive element. The layer may be colored. A colorless and transparent transfer layer is usually employed.

The transfer layer is preferably peelable under a transfer condition of temperature of not more than 180° C. and/or pressure of not more than 30 Kgf/cm$^2$, more preferably temperature of not more than 160° C. and/or pressure of not more than 20 Kgf/cm$^2$. When the transfer layer is peeled below the above-described upper limit of transfer condition, there is no problem in practice since a large-sized apparatus is almost unnecessary in order to maintain the desired heat capacity and pressure sufficient for release of the transfer layer from the surface of light-sensitive element and transfer to a receiving material, and the transfer is sufficiently performed at an appropriate transfer speed. While there is no particular lower limit thereof, ordinarily it is preferred to use the transfer layer which is peelable at temperature of not less than room temperature or at a pressure of not less than 100 kgf/cm$^2$.

It is desired for the transfer layer (T) not to deteriorate electrophotographic characteristics (for example, chargeability, dark charge retention rate and photosensitivity) of the electrophotographic light-sensitive element because a toner image is formed thereon by the electrophotographic process. Also, the first transfer layer ($T_1$) preferably has the desired mechanical strength since it constitutes the uppermost layer on a receiving material after the transfer.

As described above, the resin grain (AR) used for the formation of first transfer layer ($T_1$) contains two kinds of the resin (AH) and the resin ($AL_1$) having glass transition points or softening points different from each other by at least 2° C. The resin (AH) and the resin ($AL_1$) are appropriately selected taking their glass transition points or softening points into consideration. The resin (AH) has a glass transition point of preferably from 30° C. to 120° C., and more preferably from 35° C. to 90° C., or a softening point of preferably from 38° C. to 160° C., and more preferably from 40° C. to 120° C., and on the other hand, the resin ($AL_1$) has a glass transition point of preferably from −30° C. to 40° C., and more preferably from −20° C. to 33° C., or a softening point of preferably from 0° C. to 40° C., and more preferably from 5° C. to 35° C. The difference in the glass transition point or softening point between the resin (AH) and the resin ($AL_1$) used is preferably at least 5° C., and more preferably at least 10° C. The difference in the glass transition point or softening point between the resin (AH) and the resin ($AL_1$) means a difference between the lowest glass transition point or softening point of those of the resins (AH) and the highest glass transition point or softening point of those of the resins ($AL_1$) when two or more of the resins (AH) and/or resins ($AL_1$) are employed.

The resin (AH) and resin ($AL_1$) are present in the resin grain (AR) in a preferable weight ratio of resin (AH)/resin ($AL_1$) ranging from 10/90 to 95/5. In the above described range of weight ratio of resin (AH)/resin ($AL_1$), good transferability of transfer layer is obtained. Further, a color duplicate obtained has a good filing property. Specifically, when the color duplicate has been filed between plastic sheets, a problem in that the transfer layer adheres to the plastic sheet to cause peeling off of the transfer layer together with the toner image does not occur. A more preferred weight ratio of resin (AH)/resin ($AL_1$) is from 30/70 to 90/10.

Two or more kinds of the resin (AH) and resin ($AL_1$) may be present in the state of admixture or may form a layered structure such as a core/shell structure composed of a portion mainly comprising the resin (AH) and a portion mainly comprising the resin ($AL_1$) in the resin grain (AR) of the present invention. In case of core/shell structure, the resin constituting the core portion is not particularly limited and may be the resin (AH) or the resin ($AL_1$).

When the resin grain (AR) having a core/shell structure wherein the shell portion is composed of the resin (AH) is used, preservability, for example, the filing property described above of a color duplicate obtained is further improved, since the surface side of transfer layer transferred onto a receiving material is mainly composed of the resin (AH) having a high glass transition point or softening point. Further, the retouching property and the sealing property similar to those of plain paper can be imparted to the resulting color duplicate by appropriately selecting the kind of the resin (AH) used.

The transfer layer according to the present invention is further characterized in that the second transfer layer ($T_2$) provided on the first transfer layer ($T_1$) contains the resin ($AL_2$). The resin ($AL_2$) has a glass transition point of preferably from −20° C. to 30° C., and more preferably from −10° C. to 30° C., or a softening point of from 20° C. to 45° C., and more preferable from 25° C. to 45° C. The resin ($AL_2$) used in the second transfer layer ($T_2$) may be same as or different from the resin ($AL_1$) used in the first transfer layer ($T_1$).

It is desired that the resin ($AL_2$) used in the second transfer layer ($T_2$) has a glass transition point or a softening point lower, preferably at least 2° C. lower, more preferably at least 5° C. lower, than one of the resin (AH) contained in the resin grain (AR) used in the first transfer layer ($T_1$). It is particularly preferred that the resin (AH) in the resin grain (AR) has a glass transition point of not less than 25° C. or a softening point of not less than 35° C. and the resin ($AL_2$) used in the second transfer layer ($T_2$) has a glass transition point or softening point lower by 10° C. to 40° C. than that of the resin (AH).

A weight average molecular weight of each of the resins (AH), ($AL_1$) and ($AL_2$) (hereinafter collectively referred to as a resin (A) sometimes) is preferably from $1\times10^3$ to $5\times10^5$, more preferably from $3\times10^3$ to $8\times10^4$. The molecular weight herein defined is measured by a GPC method and calculated in terms of polystyrene. It is abbreviated as Mw hereinafter sometimes.

The resins (A) which can be used in the transfer layer (T) include thermoplastic resins and resins conventionally known as adhesive or stick. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins.

Specific examples of resins are described, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook (Oyo-hen)*, Ch. 1, Baifukan (1986), Yuji Harasaki, *Saishin Binder Gijutsu Binran*, Ch. 2, Sogo Gijutsu Center (1985), Taira Okuda (ed.), *Kobunshi Kako*, Vol. 20, Supplement "Nenchaku", Kobunshi Kankokai (1976), Keizi Fukuzawa, *Nenchaku Gijutsu*, Kobunshi Kankokai (1987), Mamoru Nishiguchi, *Secchaku Binran*, 14th Ed., Kobunshi Kankokai (1985), and Nippon Secchaku Kokai (ed.), *Secchaku Handbook*, 2nd Ed., Nikkan Kogyo Shinbunsha (1980).

The resin (A) used in the first transfer layer ($T_1$) according to the present invention may contain a polymer component (f) containing a moiety having at least one of a fluorine atom and a silicon atom which is effective to increase the peelability of the resin (A) itself. Using such a resin, releasability of the transfer layer from an electrophotographic light-sensitive element is increased and as a result, the transferability is improved.

The content of polymer component (f) is preferably from 3 to 40 parts by weight, more preferably from 5 to 25 parts by weight per 100 parts by weight of the total polymer components of the resin (A). The moiety having a fluorine atom and/or a silicon atom contained in the resin (A) includes that incorporated into the main chain of the polymer and that contained as a substituent in the side chain of the polymer. The polymer component (f) may be incorporated into any of the resin (AH) and the resin ($AL_1$). The polymer components (f) are preferably present as a block in the resin (A).

The polymer component (f) is the same as the polymer component (F) containing a moiety having a fluorine atom and/or a silicon atom described with respect to the resin (P) set forth in detail hereinafter. Embodiments of polymerization patterns of the block copolymers and methods for the preparation of copolymers are the same as those described for the resin (P) hereinafter.

If desired, the transfer layer (T) may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The total thickness of transfer layer is suitably from 0.1 to 20 μm, preferably from 0.5 to 10 μm and more preferably from 1 to 5 μm. A thickness ratio of first transfer layer ($T_1$)/second transfer layer ($T_2$) is preferably from 99/1 to 5/95 and more preferably from 95/5 to 30/70. If the transfer layer is too thin, transfer is not performed sufficiently. On the other hand, it is not preferred that the transfer layer is too thick because distortion may occur in the transferred image due to expansion and contraction of the transfer layer.

According to the present invention, the thermoplastic resin grains (AR) each containing the resin (AH) and resin ($AL_1$) each having the specific glass transition point or softening point described above are applied to the surface of electrophotographic light-sensitive element by an electrodeposition coating method and then transformed into a uniform thin film, for example, by heating, whereby the first transfer layer ($T_1$) is formed. The electrodeposition coating method used herein means a method wherein the resin grains (AR) are electrostatically adhered or electrodeposited on the surface of electrophotographic light-sensitive element.

The thermoplastic resin grains (AR) must have either a positive charge or a negative charge. The electroscopicity of the resin grains is appropriately determined depending on a charging property of the electrophotographic light-sensitive element to be used in combination.

An average grain diameter of the resin grains (AR) having the physical property described above is generally in a range of from 0.01 to 10 μm, preferably from 0.05 to 5 μm and more preferably from 0.1 to 1 μm. The resin grains may be employed as powder grains (in case of dry type electrodeposition), grains dispersed in a non-aqueous system (in case of wet type electrodeposition), or grains dispersed in an electrically insulating organic substance which is solid at normal temperature but becomes liquid by heating (in case of pseudo-wet type electrodeposition). The resin grains dispersed in a non-aqueous system are preferred since they can easily prepare the peelable transfer layer of uniform and small thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains electrically charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a seed polymerization method. Specifically, fine grains of resin (AH) (or resin ($AL_1$)) are first prepared by a dispersion polymerization method in a non-aqueous system conventionally known as described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975), and then using these fine grains as seeds, the desired resin grains are prepared by supplying monomer(s) corresponding to resin ($AL_1$) (or resin (AH)) in the same manner as above.

The resin grains composed of a random copolymer containing the polymer component (f) can be easily obtained by performing a polymerization reaction using one or more monomers forming the resin (A) which are soluble in an organic solvent but become insoluble therein by being polymerized together with a monomer corresponding to the polymer component (f) according to the polymerization granulation method described above.

The resin grains containing the polymer component (f) as a block can be prepared by conducting a polymerization reaction using, as a dispersion stabilizing resins, a block copolymer containing the polymer component (f) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (f) as main repeating unit together with one ore more monomers forming the resin (A). Alternatively, the resin grains composed of block copolymer can be obtained by conducting a polymerization reaction using a polymer initiator (for example, azobis polymer initiator or peroxide polymer initiator) containing the polymer component (f) as main repeating unit.

As the non-aqueous solvent used for the preparation of resin grains dispersed in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is preferably a non-aqueous solvent having an electric resistance of not less than $10^8$ Ω.cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu*, *Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are employed.

The dispersion of resin grains in a non-aqueous system (latex) which can be employed for electrodeposition usually comprises from 0.1 to 20 g of grains containing the thermoplastic resin, from 0.01 to 50 g of a dispersion stabilizing resin and if desired, from 0.0001 to 10 g of a charge control agent per one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω.cm, a sufficient amount of the thermoplastic resin grains deposited is reluctant to obtain and, hence, it is necessary to control the amounts of these additives in the range of not lowering the electric resistance than $10^8$ Ω.cm.

The thermoplastic resin grains (AR) which are prepared, provided with an electrostatic charge and dispersed in an electrically insulting liquid behave in the same manner as an electrophotographic wet type developing agent. For instance, the resin grains can be subjected to electrophoresis on the surface of electrophotographic light-sensitive element using a developing device, for example, a slit development electrode device as described in *Denshishashin Gijutsu no Kiso to Oyo*, pp. 275 to 285, mentioned above. Specifically, the grains comprising the thermoplastic resin are supplied between the electrophotographic light-sensitive element and an electrode placed in face of the electrophotographic light-sensitive element, and migrated by electrophoresis according to a potential gradient applied from an external power source to cause the grains to adhere to or electrodeposit on the electrophotographic light-sensitive element, whereby a film is formed.

In general, if the charge of grains is positive, an electric voltage was applied between an electroconductive support of the electrophotographic light-sensitive element and a development electrode of a developing device from an external power source so that the electrophotographic light-sensitive material is negatively charged, thereby the grains being electrostatically electrodeposited on the surface of electrophotographic light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The medium for the resin grains dispersed therein which becomes liquid by heating is an electrically insulating organic compound which is solid at normal temperature and becomes liquid by heating at temperature of from 30° C. to 80° C., preferably from 40° C. to 70° C. Suitable compounds include paraffins having a solidifying point of from 30° C. to 80° C., waxes, low molecular weight polypropylene having a solidifying point of from 20° C. to 80° C., beef tallow having a solidifying point of from 20° C. to 50° C. and hardened oils having a solidifying point of from 30° C. to 80° C. They may be employed individually or as a combination of two or more thereof.

Other characteristics required are same as those for the dispersion of resin grains used in the wet type developing method.

The resin grains used in the pseudo-wet type electrodeposition according to the present invention can stably maintain their state of dispersion without the occurrence of heat adhesion of dispersed resin grains by forming a core/shell structure wherein the core portion is composed of a resin having a lower glass transition point or softening point and the shell portion is composed of a resin having a higher glass transition point or softening point which is not softened at the temperature at which the medium used becomes liquid.

The amount of thermoplastic resin grain adhered to the electrophotographic light-sensitive element can be appropriately controlled, for example, by modifying an external bias voltage applied, a potential of the electrophotographic light-sensitive element charged and a processing time.

After the electrodeposition of grains, the liquid is wiped off upon squeeze using a rubber roller, a gap roller or a reverse roller. Other known methods, for example, corona squeeze and air squeeze can also be employed. Then, the deposit is dried with cool air or warm air or by an infrared lamp preferably to be rendered the thermoplastic resin grains in the form of a film, whereby the first transfer layer ($T_1$) is formed.

On the first transfer layer ($T_1$) provided on the surface of electrophotographic light-sensitive element, the second transfer layer ($T_2$) is then provided.

In order to form the second transfer layer ($T_2$) on the first transfer layer ($T_1$), conventional layer-forming methods can be employed. For instance, a solution or dispersion containing the composition for the second transfer layer ($T_2$) is applied onto the first transfer layer ($T_1$) in a known manner. An embodiment in which the second transfer layer ($T_2$) is formed on the first transfer layer ($T_1$) in an apparatus for performing the electrophotographic process is desirable in view of saving a running cost for the formation of color duplicate. In particular, for the formation of second transfer layer ($T_2$) on the first transfer layer ($T_1$), a hot-melt coating method or a transfer method from a releasable support is preferably used as well as the electrodeposition coating method described above. These methods are preferred in view of easy formation of the second transfer layer ($T_2$) on the first transfer layer ($T_1$) in the electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the first transfer layer ($T_1$). Suitable examples of coating machines include a direct roll coater, an offset gravure roll coater, a rod coater, an extrusion coater, a slot orifice coater, and a curtain coater.

A melting temperature of resin for the second transfer layer ($T_2$) at coating is usually in a range of from 40° to 180° C., while the optimum temperature is determined depending on the composition of resin to be used. It is preferred that the resin is first molten using a closed pre-heating device having an automatic temperature controlling means and then heated in a short time to the desired temperature in a position to be coated on the first transfer layer ($T_1$). To do so can prevent from degradation of the resin upon thermal oxidation and unevenness in coating.

A coating speed may be varied depending on flowability of the resin at the time of being molten by heating, a kind of coater, and a coating amount, etc., but is suitably in a range of from 1 to 200 mm/sec, preferably from 50 to 150 mm/sec.

Now, the formation of the second transfer layer ($T_2$) by the transfer method from a releasable support will be described below. According to this method, the second transfer layer ($T_2$) provided on a releasable support typically represented by release paper (hereinafter simply referred to as release paper) is transferred onto the first transfer layer ($T_1$).

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Soho Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating, or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K.K.), San Release (manufactured by Sanyo Kokusaku Pulp K.K.) and NK High Release (manufactured by Nippon Kako Seishi K.K.).

In order to form the second transfer layer ($T_2$) on release paper, a composition for the transfer layer mainly composed of the resin ($AL_2$) is applied to releasing paper in a conventional manner, for example, by bar coating, spin coating or spray coating to form a film. The transfer layer may also be formed on release paper by a hot-melt coating method or an electrodeposition coating method.

For a purpose of heat transfer of the second transfer layer ($T_2$) on release paper onto the first transfer layer ($T_1$)

provided on the electrophotographic light-sensitive element, conventional heat transfer methods are utilized. Specifically, release paper having the second transfer layer ($T_2$) thereon is pressed on the first transfer layer ($T_1$) provided on the electrophotographic light-sensitive element to heat transfer the second transfer layer ($T_2$).

The conditions for transfer of the second transfer layer ($T_2$) from release paper onto the first transfer layer ($T_1$) are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 200 mm/sec and more preferably from 10 to 150 mm/sec. The speed of transportation may differ from that of the electrophotographic process, or that of the heat transfer step of the transfer layer to a receiving material.

The electrodeposition coating method used to form the second transfer layer ($T_2$) on the first transfer layer ($T_1$) is substantially same as that described for the formation of the first transfer layer ($T_1$). Specifically, the second transfer layer ($T_2$) can be formed in the same manner as described above using resin grains of the thermoplastic resin ($AL_2$) (hereinafter referred to as resin grains ($AL_2R$) sometimes) in place of the thermoplastic resin grains (AR) for the formation of first transfer layer ($T_1$). By using the electrodeposition coating method for the formation of second transfer layer ($T_2$), it is possible to make an apparatus for the formation of transfer layer compact.

Now, the electrophotographic light-sensitive element which can be used in the present invention will be described in detail below.

Any conventionally known electrophotographic light-sensitive element can be employed. What is important is that the surface of the electrophotographic light-sensitive element has the specified releasability at the time for the formation of first transfer layer ($T_1$) by the electrodeposition coating method using the resin grains (AR) so as to easily release the transfer layer provided thereon together with toner images.

More specifically, an electrophotographic light-sensitive element wherein an adhesive strength of the surface thereof measured according to the method described below is not more than 100 gram.force (gf) is preferably employed.

The measurement of adhesive strength is conducted according to JIS Z 0237-1980 "Testing methods of pressure sensitive adhesive tapes and sheets" 8.3.1. 180 *Degrees Peeling Method* with the following modifications:

(i) As a test plate, an electrophotographic light-sensitive element comprising a substrate and a photoconductive layer, on the surface of which a transfer layer is to be provided is used.

(ii) As a test piece, a pressure resistive adhesive tape of 6 mm in width prepared according to JIS C 2338-1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The adhesive strength of the surface of electrophotographic light-sensitive element is more preferably not more than 50 gf, and particularly preferably not more than 30 gf.

Since releasability of the transfer layer is improved by using such an electrophotographic light-sensitive element having the desired releasable surface, the transfer layer is easily released from the electrophotographic light-sensitive element at the time of heat-transfer to a receiving material.

In order to obtain an electrophotographic light-sensitive element having a surface of the desired releasability on which the transfer layer is provided, there are a method of using an electrophotographic light-sensitive element which has already the surface exhibiting the desired releasability (first method), a method of applying a compound (S) exhibiting the desired releasability to a surface of electrophotographic light-sensitive element before the formation of transfer layer (second method), and a method of wet-type electrodeposition using a dispersion containing the resin grains (AR) and a compound (S') exhibiting the redesired releasability (third method). These methods may be employed in combination.

One example of the electrophotographic light-sensitive elements previously having the surface of releasability used in the first method includes that employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750. Also, a method of adsorbing and fixing the compound (S) according to the present invention, particularly a releasing agent containing a component having a fluorine atom and/or a silicon atom as a substituent in the form of a block (for example, a polyether-, carboxylic acid-, amino group- or carbinol-modified polydialkylsilicone) as described in detail below can be employed.

Further, another example of the electrophotographic light-sensitive elements previously having the surface of releasability is an electrophotographic light-sensitive element containing a polymer having a polymer component containing a fluorine atom and/or a silicon atom in the region near to the surface thereof.

The term "region near to the surface of electrophotographic light-sensitive element" used herein means the uppermost layer of the electrophotographic light-sensitive element and includes an overcoat layer provided on a photoconductive layer and the uppermost photoconductive layer. Specifically, an overcoat layer which contains the above-described polymer to impart the releasability is provided on the electrophotographic light-sensitive element having a photoconductive layer as the uppermost layer, or the above-described polymer is incorporated into the uppermost layer of a photoconductive layer (including a single photoconductive layer and a laminated photoconductive layer) to modify the surface thereof so as to exhibit the releasability. By using such an electrophotographic light-sensitive element, the transfer layer (T) can be easily and completely transferred together with a toner image since the surface of the electrophotographic light-sensitive element has the good releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type block copolymer) in combination with other binder resins. Further, such polymers containing a silicon atom and/or a fluorine atom are employed in the form of grains.

The surface-localized type copolymer is ordinarily used in a proportion of from 0.1 to 20 parts by weight per 100 parts by weight of the total composition of the overcoat layer, or in a proportion of from 0.5 to 30 parts by weight per 100 parts by weight of the total composition of the uppermost photoconductive layer.

Specific examples of the overcoat layer include a protective layer which is a surface layer provided on the light-sensitive element for protection known as one means for ensuring durability of the surface of light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-61-139555, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Publication No. 534,479A1.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in European Patent Publication No. 534,479A1. Alternatively, a photo- and/or heat-curable resin may be used in combination with the fluorine atom and/or silicon atom-containing resin in the present invention.

The polymer comprising a polymer component (F) containing a fluorine atom and/or a silicon atom effectively used for modifying the surface of the electrophotographic light-sensitive material according to the present invention include a resin (hereinafter referred to as resin (P) sometimes) and resin grain (hereinafter referred to as resin grain (PL) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. More preferably, the polymer segment (β) of the block copolymer contains at least one polymer component containing at least one photo- and/or heat-curable functional group.

It is preferred that the polymer segment (β) does not contain any fluorine atom and/or silicon atom-containing polymer component.

As compared with the random copolymer, the block copolymer comprising the polymer segments (α) and (β) (surface-localized type copolymer) is more effective not only for improving the surface releasability but also for maintaining such a releasability.

More specifically, where a film is formed in the presence of a small amount of the resin (P) or resin grains (PL), the resins (P) or resin grains (PL) easily migrate to the surface portion of the film and are concentrated there by the end of a drying step of the film to thereby modify the film surface so as to exhibit the releasability.

Where the resin (P) is the block copolymer in which the fluorine atom and/or silicon atom-containing polymer segment (α) exists as a block, the other polymer segment (β) containing no, or if any a small proportion of, fluorine atom and/or silicon atom-containing polymer component undertakes sufficient interaction with the film-forming binder resin since it has good compatibility therewith. Thus, during the formation of the transfer layer on the electrophotographic light-sensitive element, further migration of the resin into the transfer layer is inhibited or prevented by an anchor effect to form and maintain the definite interface between the transfer layer and the electrophotographic light-sensitive element.

Further, where the segment (β) of the block copolymer contains a photo- and/or heat-curable group, crosslinking between the polymer molecules takes place during the film formation to thereby ensure retention of the releasability at the interface between the light-sensitive element and the transfer layer. Such a crosslinked structure is particularly advantageous when the light-sensitive element is repeatedly employed and when a liquid developer is used for the formation of toner image.

The above-described polymer may be used in the form of resin grains as described above. Preferred resin grains (PL) are resin grains dispersible in a non-aqueous solvent. Such resin grains include a block copolymer comprising a non-aqueous solvent-insoluble polymer segment (α) which contains a fluorine atom and/or silicon atom-containing polymer component and a non-aqueous solvent-soluble polymer segment (β) which contains no, or if any not more than 20% of, fluorine atom and/or silicon atom-containing polymer component.

Where the resin grains (PL) according to the present invention are used in combination with a binder resin, the insolubilized polymer segment (α) undertakes migration of the grains to the surface portion and concentration there while the soluble polymer segment (β) exerts an interaction with the binder resin (an anchor effect) similarly to the above-described resin (P). When the resin grains contain a photo- and/or heat-curable group, further migration of the grains to the transfer layer can be avoided.

Now, a moiety having a fluorine atom and/or a silicon atom, a polymer component (F) containing the moiety and an embodiment of polymerization patterns of a block copolymer containing the polymer component (F), and a method for the preparation of the copolymer will be described in detail below.

The polymer component (F) is a polymer component containing the moiety having a fluorine atom and/or a silicon atom.

The moiety having a fluorine atom and/or a silicon atom contained in the resin (P) or resin grains (PL) includes that incorporated into the main chain of the polymer and that contained as a substituent in the side chain of the polymer.

The fluorine atom-containing moieties include monovalent or divalent organic residues, for example, $—C_hF_{2h+1}$ (wherein h represents an integer of from 1 to 22), $—(CF_2)_jCF_2H$ (wherein j represents an integer of from 1 to 17), $—CFH_2$,

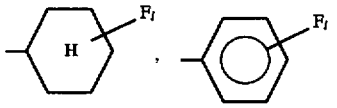

(wherein l represents an integer of from 1 to 5), $—CF_2—$, —CFH—,

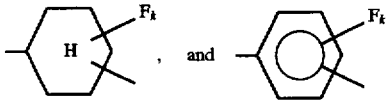

(wherein k represents an integer of from 1 to 4).

The silicon atom-containing moieties include monovalent or divalent organic residues, for example,

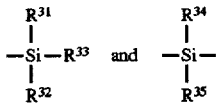

wherein $R^{31}$, $R^{32}$, $R^{33}$, $R^{34}$ and $R^{35}$, which may be the same or different, each represents a hydrocarbon group which may be substituted or $—OR^{36}$ wherein $R^{36}$ represents a hydrocarbon group which may be substituted.

The hydrocarbon group represented by $R^{31}$, $R^{32}$, $R^{33}$, $R^{34}$, $R^{35}$ or $R^{36}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2'2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl).

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—,

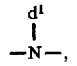

—CO—, —SO—, $—SO_2—$, —COO—, —OCO—, —CONHCO—, —NHCONH—,

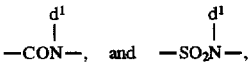

wherein $d^1$ has the same meaning as $R^{31}$ above.

Examples of the divalent aliphatic groups are shown below.

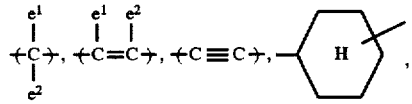

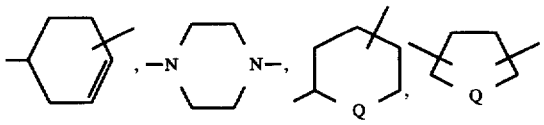

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

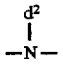

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (F-1) to (F-32) below, Rf represents any one of the following groups of from (1) to (11); and b represents a hydrogen atom or a methyl group.

$-C_nF_{2n+1}$ (1)

$-CH_2C_nF_{2n+1}$ (2)

$-CH_2CH_2C_nF_{2n+1}$ (3)

$-CH_2(CF_2)_mCFHCF_3$ (4)

$-CH_2CH_2(CF_2)_mCFHCF_3$ (5)

$-CH_2CH_2(CF_2)_mCFHCF_2H$ (6)

$-CH_2(CF_2)_mCFHCF_2H$ (7)

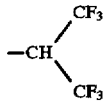
(8)

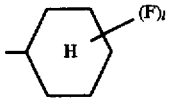
(9)

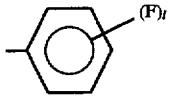
(10)

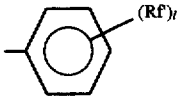
(11)

wherein Rf' represents any one of the above-described groups of from (1) to (8); n represents an integer of from 1 to 18; m represents an integer of from 1 to 18; and l represents an integer of from 1 to 5.

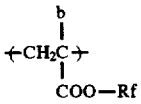
(F-1)

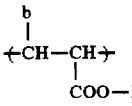
(F-2)

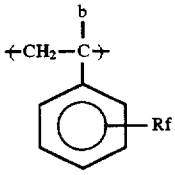
(F-3)

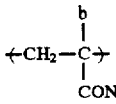
(F-4)

-continued

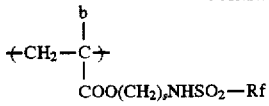
(F-5)

(s: an interger of from 1 to 12)

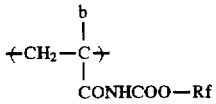
(F-6)

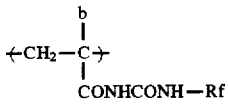
(F-7)

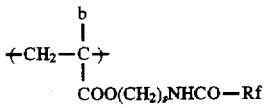
(F-8)

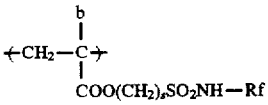
(F-9)

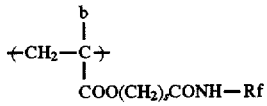
(F-10)

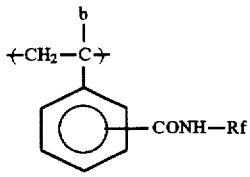
(F-11)

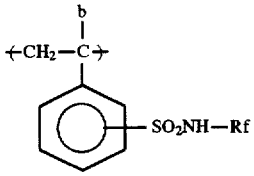
(F-12)

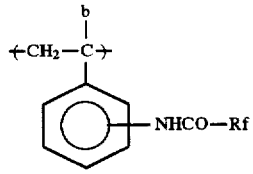
(F-13)

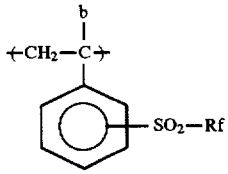
(F-14)

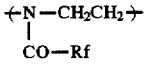
(F-15)

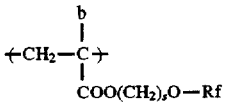
(F-16)

-continued (F-17)

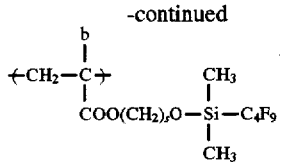

(F-18)

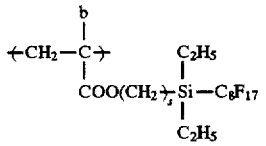

(F-19)

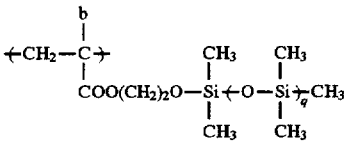

q: an integer of from 1 to 20

(F-20)

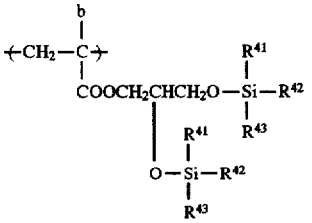

$R^{41}$, $R^{42}$, $R^{43}$: an alkyl group having from 1 to 12 carbon atoms (F-21)

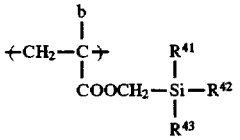

(F-22)

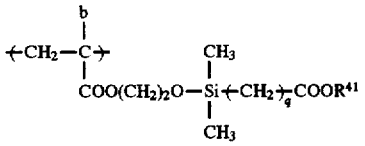

(F-23)

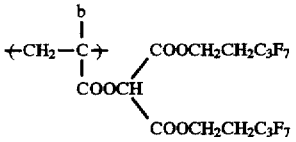

(F-24)

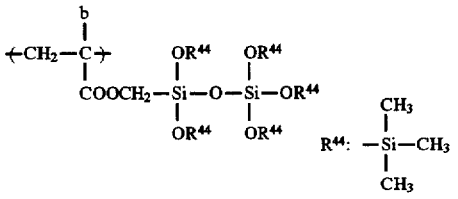

(F-25)

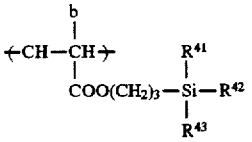

-continued (F-26)

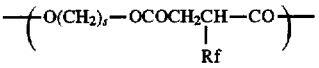

(F-27)

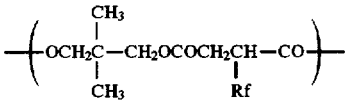

(F-28)

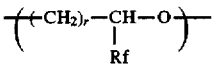

r: an integer of from 3 to 6

(F-29)

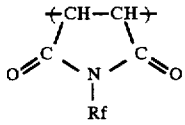

(F-30)

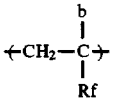

(F-31)

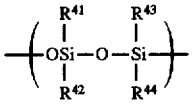

(F-32)

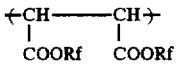

Of the resins (P) and resin grains (PL) each containing silicon atom and/or fluorine atom used in the uppermost layer of the electrophotographic light-sensitive element according to the present invention, the so-called surface-localized type copolymers will be described in detail below.

The content of the silicon atom and/or fluorine atom-containing polymer component (F) in the segment (α) is at least 50% by weight, preferably at least 70% by weight, and more preferably at least 80% by weight. The content of the fluorine atom and/or silicon atom-containing polymer component (F) in the segment (β) bonded to the segment (α) is not more than 20% by weight, and preferably 0% by weight.

A weight ratio of segment (α) to segment (β) ranges usually from 1/99 to 95/5, and preferably from 5/95 to 90/10. In the above-described range of weight ratio, the migration effect and anchor effect of the resin (P) or resin grain (PL) at the surface region of light-sensitive element are well achieved.

The resin (P) preferably has a weight average molecular weight of from $5\times10^3$ to $1\times10^6$, and more preferably from $1\times10^4$ to $5\times10^5$. The segment (α) in the resin (P) preferably has a weight average molecular weight of at least $1\times10^3$.

The resin grain (PL) preferably has an average grain diameter of from 0.001 to 1 μm, and more preferably from 0.05 to 0.5 μm.

A preferred embodiment of the resin (P) will be described below. The resin (P) may be any type of copolymer as far as it contains the fluorine atom and/or silicon atom-containing polymer components (F) as a block. The term "to be contained as a block" means that the resin (P) has a polymer segment comprising at least 50% by weight of the fluorine atom and/or silicon atom-containing polymer component based on the weight of the polymer segment. The forms of blocks include an A—B type block, an A—B—A type block, a B—A—B type block, a graft type block, and a starlike type block as schematically illustrated below.

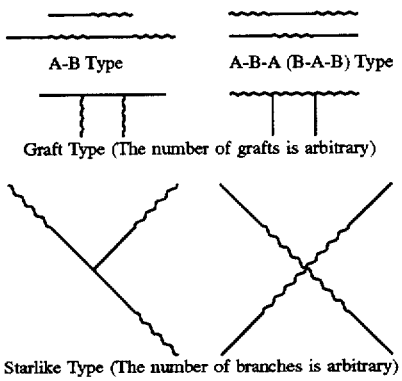

— : Segment α (containing fluorine atom and/or silicon atom)

~ : Segment β (containing no or little fluorine atom and/or silicon atom)

These various types of block copolymers of the resins (P) can be synthesized in accordance with conventionally known polymerization methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985), T. E. Hogeu-Esch and J. Smid, *Recent Advances in Anion Polymerization*, Elsevier (New York) (1987), S. Kobayashi and T. Saegusa, *Ring Opening Polymerization*, Applied Science Publishers Ltd. (1984), and Fumio Ide, *Graft Jugo to Sono Oyo*, Kobunshi Kankokai (1977).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator, group transfer polymerization reactions, living polymerization reactions using a metallo-porphyrin complex, photo living polymerization reactions using a dithiocarbamate compound or a xanthate compound, as an initiator, radical polymerization reactions using a polymer containing an azo group or a peroxide group as an initiator, polymerization reactions using a macromonomer, and methods of grafting using a polymer are employed. Specific methods for the syntheses of these copolymers are described in European Patent Publication No. 534,479A1.

While reference can be made to known techniques described in the literatures cited above, the method for synthesizing the block copolymers of the resins (P) according to the present invention is not limited to these methods.

A preferred embodiment of the resin grain (PL) according to the present invention will be described below. As described above, the resin grain (PL) preferably comprises the fluorine atom and/or silicon atom-containing polymer segment (α) insoluble in a non-aqueous solvent and the polymer segment (β) which is soluble in a non-aqueous solvent and contains substantially no fluorine atom and/or silicon atom. The polymer segment (α) constituting the insoluble portion of the resin grain (PL) may have a crosslinked structure.

A preferred method for synthesizing the resin grain (PL) includes a dispersion polymerization method in a non-aqueous solvent system described below with respect to a non-aqueous solvent-dispersed resin grain.

The non-aqueous solvents which can be used in the preparation of non-aqueous solvent-dispersed resin grains include any organic solvents having a boiling point of not more than 200° C., either individually or in combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

Dispersion polymerization in such a non-aqueous solvent system easily results in the production of mono-dispersed resin grains having an average grain diameter of not greater than 1 μm with a very narrow size distribution.

The inside of the resin grain (PL) according to the present invention may have a crosslinked structure. The formation of crosslinked structure can be conducted by any of conventionally known techniques. For example, a method wherein a polymer containing the polymer segment (α) is crosslinked in the presence of a cross-linking agent or a curing agent, or a method wherein at least the monomer (a) corresponding to the polymer segment (α) is polymerized in the presence of a polyfunctional monomer or oligomer containing at least two polymerizable functional groups to form a network structure over molecules.

The crosslinking agents, curing agents, and polyfunctional compounds to be used in the methods described above include those commonly employed as described, e.g., in Shinzo Yamashita and Tosuke Kaneko (ed.), *Kakyozai Handbook*, Taiseisha (1981) and Kobunshi Gakkai (ed.), *Kobunshi Data Handbook (Kiso-hen)*, Baifukan (1986), Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples thereof include organosilane compounds, organic titanate compounds, organic aluminate compounds, polyisocyanate compounds, blocked polyisocyanate compounds, polyol compounds, polyamine compounds, modified aliphatic polyamine compounds, polyepoxy-containing compounds, epoxy resins, melamine resins, and poly(meth)acrylate compounds.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° C. to about 180° C., and preferably from 40° C. to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group ranges preferably from 1 to 95 parts by weight, more preferably from 10 to 70 parts by weight, based on 100 parts by weight of the polymer segment (β) in the block copolymer (P). Also, the polymer component is preferably contained in the range of from 5 to 40 parts by weight per 100 parts by weight of the total polymer components in the resin (P).

In the above-described range, curing of the photoconductive layer after film formation proceeds sufficiently, the interface between the photoconductive layer and the transfer layer formed thereon is sufficiently maintained, and thus the transfer layer exhibits good releasability. Further, the electrophotographic characteristics of the photoconductive layer are well retained without degradation in reproducibility of original in a duplicated image and occurrence of background fog in the non-image area.

The photo- and/or heat-curable group-containing the resin (P) is preferably used in an amount of not more than 40% by weight based on the total binder resin. In the range described above, good electrophotographic characteristics are obtained.

The fluorine atom and/or silicon atom-containing resin may also be used in combination with a photo- and/or heat-curable resin (hereinafter referred to as resin (D) sometimes) in the present invention.

Any of conventionally known curable resins may be used as the photo- and/or heat-curable resin (D). For example, resins containing the curable group as described with respect to the block copolymer (P) may be used.

A binder resin used in the photoconductive layer is described in detail hereinafter.

If desired, a reaction accelerator may be employed for accelerating the crosslinking reaction in the layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is preferably cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° C. to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

Now, the second method for obtaining an electrophotographic light-sensitive element having a surface of the desired releasability will be described in detail below. According to the method, a compound (S) exhibiting the desired releasability is applied to a surface of a conventional electrophotographic light-sensitive element to cause the compound (S) to adhere to or adsorb on the surface before the formation of first transfer layer ($T_1$), whereby the surface of electrophotographic light-sensitive element is provided with the desired releasability.

The compound (S) is a compound containing a fluorine atom and/or a silicon atom. The compound (S) containing a moiety having a fluorine and/or silicon atom is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine and/or silicon atom-containing moieties include those described with respect to the resin (P) suitable for use in the electrophotographic light-sensitive element above.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu— Sono Gosei* to Oyo, Gijutsu Joho Kyokai (1991), and Mitsuo Ishikawa, *Yukikeiso Senryaku Shiryo*, Chapter 3, Science Forum (1991).

Specific examples of polymer components having the fluorine atom and/or silicon atom-containing moiety used in the oligomers or polymers of compound (S) include the polymer components (F) described with respect to the resin (P) above.

Of the oligomers or polymers of compounds (S), so-called block copolymers are preferred as described above. Specifically, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A—B type block, an A—B—A type block, a B—A—B type block, a graft type block, and a starlike type block as schematically illustrated with respect to the resin (P) above. These block copolymers can be synthesized according to the methods described with respect to the resin (P) above.

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is brought into close contact with the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method of migrating the compound (S) dispersed in a non-aqueous solvent to cause the compound (S) to adhere to the surface of light-sensitive element by electrophoresis according to the wet-type electrodeposition method as described above can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process of an ink on-demand type, a bubble jet process, and a mist process of an ink mist type are illustrated. In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated, if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 $Kgf/cm^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controlled using a heat medium, if desired.

The application of compound (S) is preferably performed by a means which is easily incorporated into an electrophotographic apparatus used in the present invention.

An amount of the compound (S) applied to the surface of electrophotographic light-sensitive element is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained. Specifically, when an adhesive strength of the surface of electrophotographic light-sensitive element to which the compound (S) has been applied is measured according to the method described above, the resulting adhesive strength is preferably not more than 100 g.f.

In accordance with the method described above, the surface of electrophotographic light-sensitive element is provided with the desired releasability by the application of compound (S), and the light-sensitive element can be repeatedly employed as- far as the releasability is maintained. Specifically, the application of compound (S) is not always necessarily whenever a series of steps comprising the formation of transfer layer, formation of toner image, and transfer of the toner image together with the transfer layer onto a receiving material is repeated.

The third method for obtaining an electrophotographic light-sensitive element having a surface of the desired releasability comprises conducting a wet-type electrodeposition method using a dispersion of resin grains (AR) for forming a transfer layer, to which a compound (S') exhibiting the desired releasability is added. According to the method, the dispersion for electrodeposition containing the compound (S') is subjected to electrodeposition on a conventionally known electrophotographic light-sensitive element, thereby providing the releasability on the surface of light-sensitive element as well as the formation of transfer layer.

More specifically, the dispersion for electrodeposition used comprises an electrically insulating organic solvent having a dielectric constant of not more than 3.5, the resin grains (AR) dispersed therein and the compound (S') exhibiting the desired releasability.

The compound (S') present in the dispersion for electrodeposition is able to adhere to or adsorb on the surface of electrophotographic light-sensitive element before the electrodeposition of resin grains (AR) on the surface of electrophotographic light-sensitive element by electrophoresis and as a result, the light-sensitive element having the surface of desired releasability is obtained before the formation of transfer layer.

The compounds (S') used are same as the compound (S) described in the second method above in substance. Of the compound (S'), those soluble at least 0.05 g per one liter of an electrically insulating organic solvent used in the dispersion for electrodeposition at 25° C. are preferred, and those soluble 0.1 g or more per one liter of the solvent are more preferred.

The amount of compound (S') added to the dispersion for electrodeposition may by varied depending on the compound (S') and the electrically insulating organic solvent to be used. A suitable amount of the compound (S') is determined taking the effect to be obtained and adverse affects on electrophoresis of resin grains (e.g., decrease in electric resistance or increase in viscosity of the dispersion) into consideration. A preferred range of the compound (S) added is ordinarily from 0.05 to 20 g per one liter of the electrically insulating organic solvent used.

The construction and material used for the electrophotographic light-sensitive element according to the present invention are not particularly limited and any of those conventionally known can be employed.

Suitable examples of electrophotographic light-sensitive element used are described, for example, in Denshishashin Gakkai (ed.), *Denshishashin Gijutsu no Kiso to Oyo*, Corona (1988), Hiroshi Kokado (ed.), *Saikin no Kododen Zairyo to Kankotai no Kaihatsu.Jitsuyoka*, Nippon Kagaku Joho (1985), Takaharu Shibata and Jiro Ishiwatari, *Kobunshi*, Vol. 17, p. 278 (1968), Harumi Miyamoto and Hidehiko Takei, *Imaging*, Vol. 1973, No. 8, Denshishashin Gakkai (ed.), *Denshishashinyo Yukikankotai no Genjo Symposium* (preprint) (1985), R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), and Hiroshi Kokado, *Kagaku to Kogyo*, Vol. 39, No. 3, p. 161 (1986).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure.

The photoconductive compounds used in the present invention may be inorganic compounds or organic compounds.

Inorganic photoconductive compounds used in the present invention include those conventionally known, for example, zinc oxide, titanium oxide, zinc sulfide, cadmium sulfide, selenium, selenium-tellurium, amorphous silicon, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer comprising an organic photoconductive compound, a sensitizing dye, and a binder resin, and (ii) a layer comprising a charge generating agent, a charge transporting agent, and a binder resin or a double-layered structure containing a charge generating agent and a charge transporting agent in separate layers.

The photoconductive layer of the electrophotographic light-sensitive element according to the present invention may have any of the above-described structure.

In the latter case, an organic photoconductive compound is employed as the charge transporting agent.

The organic photoconductive compounds which may be used in the present invention include, for example, triazole derivatives, oxadiazole derivatives, imidazole derivatives, polyarylalkane derivatives, pyrazoline derivatives, pyrazolone derivatives, arylamine derivatives, azulenium salt derivatives, amino-substituted chalcone derivatives, N,N-bicarbazyl derivatives, oxazole derivatives, styrylanthracene derivatives, fluorenone derivatives, hydrazone derivatives, benzidine derivatives, stilbene derivatives, polyvinylcarbazole and derivatives thereof, vinyl polymers such as polyvinylpyrene, polyvinylanthracene, poly-2-vinyl-4-(4'-dimethylaminophenyl)-5-phenyloxazole and poly-3-vinyl-N-ethylcarbazole, polymers such as polyacenaphthylene, polyindene and an acenaphthylene-styrene copolymer, triphenylmethane polymers, and condensed resins such as pyrene-formaldehyde resin, bromopyrene-formaldehyde resin and ethylcarbazole-formaldehyde resin.

The organic photoconductive compounds which can be used in the present invention are not limited to the above-described compounds, and any of known organic photoconductive compounds may be employed in the present invention. The organic photoconductive compounds may be used either individually or in combination of two or more thereof.

The charge generating agents which can be used in the photoconductive layer include various conventionally known charge generating agents, either organic or inorganic, such as selenium, selenium-tellurium, cadmium sulfide, zinc oxide, and organic pigments described below. The charge generating agent is appropriately selected to have spectral sensitivity suitable for a wavelength of a light source employed.

The organic pigments used include azo pigments (including monoazo, bisazo, trisazo, tetraazo pigments), metal-free or metallized phthalocyanine pigments, perylene pigments, indigo or thioindigo derivatives, quinacridone pigments, polycyclic quinone pigments, bisbenzimidazole pigments, squarylium salt pigments, and azulenium salt pigments.

These charge generating agents may be used either individually or in combination of two or more thereof.

The charge transporting agents used in the photoconductive layer include those described for the organic photoconductive compounds above. The charge transporting agent is appropriately selected so as to suite the charge generating agent to be employed in combination.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins which can be used in the electrophotographic light-sensitive element according to the present invention (hereinafter referred to as binder resin (B) sometimes) include those for conventionally known electrophotographic light-sensitive elements. A weight average molecular weight of the binder resin (B) is preferably from $5\times10^3$ to $1\times10^6$, and more preferably from $2\times10^4$ to $5\times10^5$. A glass transition point of the binder resin (B) is preferably from −40° to 200° C., and more preferably from −10° to 140° C.

Suitable examples of the binder resin used are described, for example, in Koichi Nakamura (ed.), *Kioku Zairyoyo Binder no Jissai Gijutsu*, Ch. 10, C.M.C. (1985), Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei.Sekkei to Shinyoto Kaihatsu*, Chubu Kei-ei Kaihatsu Center Shuppanbu (1985), Eizo Omori, *Kinosei Acryl-Kei Jushi*, Techno System (1985), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980), in addition to the literature references mentioned with respect to the electrophotographic light-sensitive element above.

Specific examples of binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styreneacrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings), and epoxy resins.

Further, the electrostatic characteristics of photoconductive layer are improved by using as the binder resin a resin having a relatively low molecular weight (e.g., a weight average molecular weight of from $10^3$ to $10^4$) and containing an acidic group such as a carboxy group, a sulfo group or a phosphono group. Suitable examples of such a resin are described, for example, in JP-A-64-70761, JP-A-2-67563, JP-A-3-181948 and JP-A-3-249659.

Moreover, in order to maintain a relatively stable performance even when ambient conditions are widely fluctuated, a specific medium to high molecular weight resin is employed as the binder resin. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Also, JP-A-3-206464 and JP-A-3-223762 discloses a resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Further, excellent electrostatic characteristics can be maintained even when ambient conditions are fluctuated or when a scanning exposure system using a semiconductor laser beam is utilized for the image exposure.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described, for example, in *Denshishashin*, Vol. 12, p. 9 (1973), *Yuki Gosei Kagaku*, Vol. 24, No. 11, p. 1010 (1966), Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), Tadaaki Tani, *Nihon Shashin Gakkaishi*, Vol. 35, p. 208 (1972), *Research Disclosure*, No. 216, pp. 117–118 (1982), and F. M. Hamer, *The Cyanine Dyes and Related Compounds*, in addition to the literature references mentioned with respect to the electrophotographic light-sensitive element above.

If desired, the electrophotographic light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

Now, the formation of toner image will be described below.

According to the present invention, to an electrophotographic light-sensitive element having a surface of the releasability is applied by an electrodeposition coating method the resin grains (AR) each containing at least two resins (AH) and ($AL_1$) having glass transition points or softening points different from each other as described above to form the first transfer layer ($T_1$), the second transfer layer ($T_2$) comprising the resin ($AL_2$) is provided thereon, and then, a toner image is formed on the transfer layer through a conventional electrophotographic process.

Specifically, each step of the electrophotographic process, i.e., charging, light exposure, development and fixing is performed in a conventionally known manner. The electrophotographic process and the formation of first transfer layer ($T_1$) and/or second transfer layer ($T_2$) may be conducted in the same apparatus or in different apparatus.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu.Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an electrically insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic pigment or dye) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin and a colorant are preferably present in an amount of from 0.5 to 50 parts by weight per 1000 parts by weight of a carrier liquid. If the toner content is less than 0.5 part by weight, the image density may be insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Particularly, a combination of a scanning exposure system using a laser beam based on digital information and a development system using a liquid developer is an advantageous process in order to form highly accurate images.

One specific example of the methods for preparing toner image is illustrated below. An electrophotographic light-sensitive element is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seq., Corona Sha (1988). A corotron or scotron system is usually used for the charging process. In a preferred charging process, the charging conditions may be controlled by a feedback system of the information on charged potential from a detector connected to the light-sensitive element thereby to control the surface potential within a predetermined range.

Thereafter, the charged light-sensitive element is exposed to light by scanning with a laser beam in accordance with the system described, for example, in *ibidem*, p. 254 et seq. Of four color separation images, first the image corresponding to a yellow part is converted to a dot pattern and exposed.

Toner development is then conducted using a liquid developer. The light-sensitive element charged and exposed is removed from the flat bed and developed according to a wet type developing method as described, for example, in *ibidem*, p. 275 et seq. The exposure mode is determined in accord with the toner image development mode. Specifically, in case of reversal development, a negative image is irradiated with a laser beam, and a toner having the same charge polarity as that of the charged light-sensitive element is electrodeposited on the exposed area with a bias voltage applied. For the details, reference can be made to *ibidem*, p. 157 et seq.

After the toner development, the light-sensitive element is squeezed to remove the excess developer as described in *ibidem*, p. 283 and dried. Preferably, the light-sensitive element rinsed with the carrier liquid alone used in the liquid developer before squeezing.

The above electrophotographic process for forming toner image is repeated with respect to a magenta, cyan and black part in case forming a full-color duplicate.

In the method of the present invention, the toner image formed on the transfer layer (T) provided on the electrophotographic light-sensitive element is then transferred together with the transfer layer (T) onto a receiving material. The heat-transfer of the toner image together with the transfer layer onto the receiving material can be performed using known methods and devices.

For example, the light-sensitive element is brought into contact with the receiving material and they are pressed by a heating roller, for example, a metal roller covered with rubber and containing therein a heating means, passed under a cooling roller and then separated, whereby the transfer layer is transferred together with the toner image onto the receiving material. The light-sensitive element and receiving material may be pre-heated in the desired temperature range by a heating means, preferably a non-contact type heater such as an infrared line heater or a flash heater, if desired.

The surface temperature of heating roller at the time of heat-transfer is preferably in a range of from 40° to 150° C., and more preferably from 45° to 120° C. The surface temperature of roller is preferably maintained within a predetermined range by a surface temperature detective means and a temperature controller.

The nip pressure of roller is preferably in a range of from 0.2 to 20 kgf/cm$^2$ and more preferably from 0.5 to 10 kgf/cm$^2$. The roller may be pressed by springs provided on opposite ends of the roller shaft or by an air cylinder using compressed air. A speed of the transportation is preferably in a range of from 1 to 500 mm/sec and more preferably in a range of from 10 to 300 mm/sec. The speed of transportation in the heat transfer step may be different from that of the electrophotographic process.

The cooling roller comprises a metal roller which has a good thermal conductivity such as aluminum, copper or the like and is covered with silicone rubber. It is preferred that the cooling roller is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller is maintained within a predetermined range.

It is needless to say that the above-described conditions for the transfer of toner image together with the transfer layer should be optimized depending on the physical properties of the light-sensitive element (i.e., the light-sensitive layer and the support), the transfer layer, and the receiving material used. Especially it is important to determine the conditions of temperature at pre-heating, roller heating and cooling in the heat transfer step taking into account the factors such as glass transition point, softening temperature, flowability, tackiness, film properties and thickness of the transfer layer.

Specifically, when the transfer layer softened to a certain extent by a pre-heating means is further heated, for example, a heating roller, the tackiness of the transfer layer increases and the transfer layer is closely adhered to the receiving material. After the transfer layer is passed under a roller for release, for example, a cooling roller, the temperature of the transfer layer is decreased to reduce the flowability and the tackiness and thus the transfer layer is peeled as a film from the surface of the light-sensitive element together with the toner image. Accordingly, the transfer conditions should be set so as to realize such a situation.

The receiving material used in the present invention is not particularly limited and any material conventionally known can be employed. Suitable examples of the receiving materials include those of reflective type, for example, natural paper such as high quality paper, coated paper or art paper, synthetic paper, a metal plate such as an aluminum, iron or SUS plate, and those of transmittive type, for example, a plastic film such as a polyester, polyolefin, polyvinyl chloride or polyacetate film.

Now, the method of forming a color image using an electrophotographic process according to the present invention will be described in detail with reference to the accompanying drawings hereinbelow.

Figure 2:
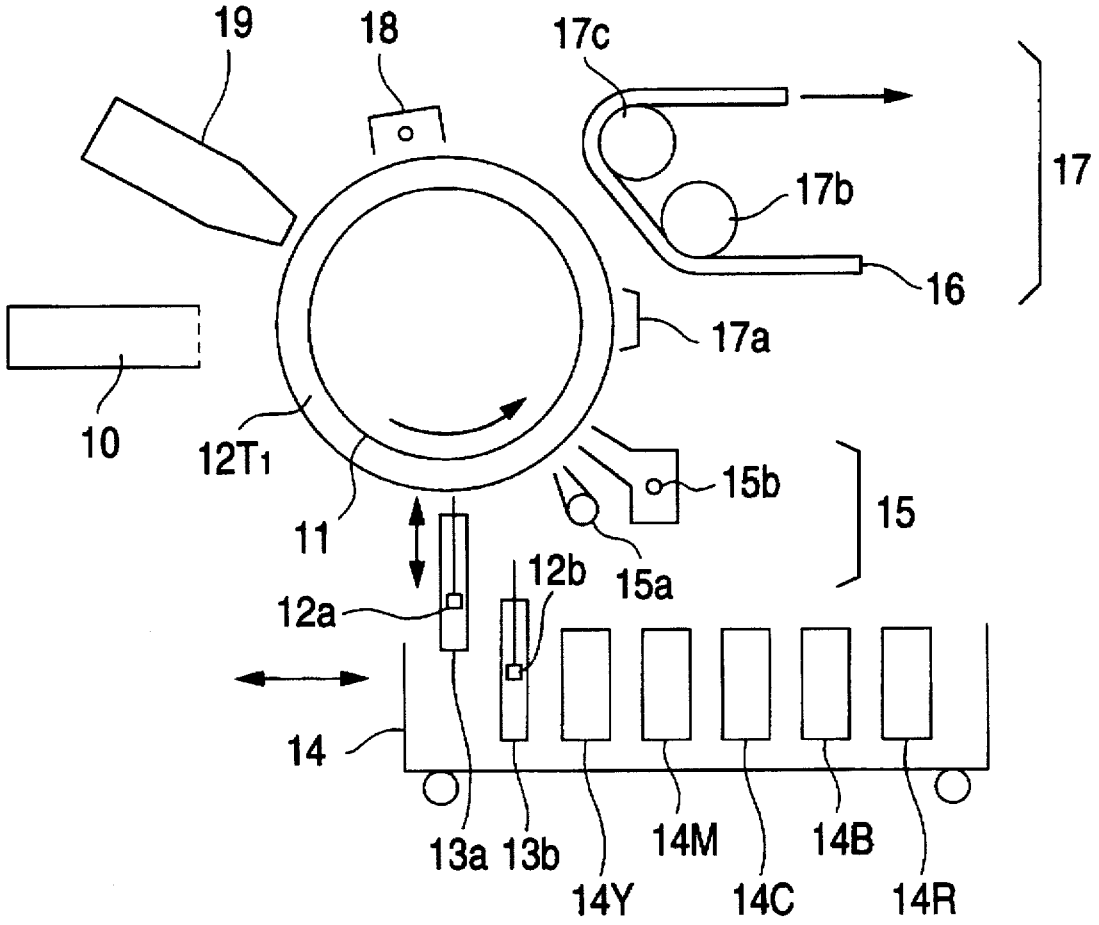
FIG. 2 is a schematic view of an electrophotographic color image-forming apparatus suitable for performing the method according to the present invention in which an electrodeposition coating method is used for the formation of second transfer layer ($T_2$).

FIG. 2 is a schematic view of an electrophotographic color image forming apparatus suitable for carrying out the method of the present invention. In the apparatus, the formation of transfer layer, electrophotographic process and heat transfer of transfer layer can be performed.

As described above, when an electrophotographic light-sensitive element 11 whose surface has been modified to have the desired releasability, a first transfer layer ($T_1$) 12$T_1$ is formed on the light-sensitive element 11. On the other hand, when the surface of light-sensitive element 11 has insufficient releasability, a means for applying the compound (S) is provided before the formation of first transfer layer ($T_1$) 12$T_1$ (in case of the second method), or the compound (S') is incorporated into a dispersion of electrodeposition containing the resin grains (AR) for the formation of transfer layer ($T_1$) according to the present invention (in case of the third method), thereby the desired releasability being imparted to the surface of light-sensitive element 11. In case of the second method, the compound (S) is supplied using an applying unit for compound (S) 10 which utilizes any one of the embodiments described above onto the surface of light-sensitive element 11. The applying unit for compound (S) 10 may be stationary or movable.

A dispersion of thermoplastic resin grain (AR) 12*a* is supplied to an electrodeposition unit 13*a* for first transfer layer provided in a movable liquid developing unit set 14. The electrodeposition unit 13*a* is first brought near the surface of the light-sensitive element 11 and is kept stationary with a gap of 1 mm between a development electrode of the electrodeposition unit 13*a* and the light-sensitive element. The light-sensitive element 11 is rotated while supplying the dispersion of thermoplastic resin grain 12*a* into the gap and applying an electric voltage across the gap from an external power source (not shown), whereby the resin grains (AR) are deposited over the entire image-forming areas of the surface of the light-sensitive element 11.

A medium of the dispersion of thermoplastic resin grain 12*a* adhered to the surface of the light-sensitive element 11 is removed by a squeezing device built in the electrodeposition unit 13*a*, and the light-sensitive element is dried by passing under the suction/exhaust unit 15. Then the thermoplastic resin grains (AR) are fused by the heating means 17*a* and thus the first transfer layer ($T_1$) 12$T_1$ in the form of thermoplastic resin film is obtained.

On the first transfer layer ($T_1$) 12$T_1$ is then provided a second transfer layer ($T_2$) 12$T_2$. In case of using the electrodeposition coating method, a dispersion of thermoplastic resin grain ($AL_2R$) 12*b* is supplied to an electrodeposition unit 13*b* for second transfer layer provided in the liquid developing unit set 14 as shown in FIG. 2 and the same procedure as the formation of first transfer layer ($T_1$) is performed to form the second transfer layer 12$T_2$.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

The light-sensitive element 11 bearing thereon the first and second transfer layers is then subjected to the electrophotographic process. Specifically, when the light-sensitive element 11 is uniformly charged to, for instance, a positive polarity by a corona charger 18 and then is exposed imagewise by an exposure device (e.g., a semi-conductor laser) 19 on the basis of yellow image information, the potential is lowered in the exposed areas and thus, a contrast in the potential is formed between the exposed areas and the unexposed areas. A yellow liquid developing unit 14Y containing a liquid developer comprising yellow pigment particles having a positive electrostatic charge dispersed in an electrically insulating dispersion medium provided in the liquid developing unit set 14 is brought near the surface of the transfer layer formed on the light-sensitive element 11 and is kept stationary with a gap of 1 mm therebetween.

The light-sensitive element is first pre-bathed by a pre-bathing means equipped in the developing unit, and then the yellow liquid developer is supplied on the light-sensitive element while applying a developing bias voltage between the light-sensitive element and a development electrode by a bias voltage source and wiring (not shown). The bias voltage is applied so that it is slightly lower than the surface potential of the unexposed areas, while the development electrode is charged to positive and the light-sensitive element is charged to negative. When the bias voltage applied is too low, a sufficient density of the toner image cannot be obtained.

The liquid developer is subsequently washed off by a rinsing unit 14R provided in the liquid developing unit and the rinse solution adhering to the light-sensitive element is removed by a squeeze means. Then, the light-sensitive element is dried by passing under the suction/exhaust unit 15. As the pre-bathing solution and the rinse solution, a carrier liquid for the liquid developer is generally used.

The above described electrophotographic process is repeated with respect to each image information of magenta, cyan and black to form color toner images on the transfer layer of the electrophotographic light-sensitive element using a magenta liquid developing unit 14M, a cyan liquid developing unit 14C and a black liquid developing unit B, respectively.

The toner image thus formed on the transfer layer is then heat-transferred onto a receiving material 16 using a transfer unit to receiving material 17. Specifically, the transfer layer bearing the toner image is pre-heated in the desired range of temperature by a heating means 17*a*, if desired, and is pressed against a metal roller covered with rubber and having therein a heating means with a temperature controller as a backup roller for transfer 17*b* with the receiving material 16 intervening therebetween. The transfer layer and the receiving material are then cooled by passing under a cooling roller as a backup roller for release 17*c*, thereby heat-transferring the toner image together with the transfer layer to the receiving material. Thus a cycle of steps for color image formation is terminated.

By stopping the apparatus in the state where the transfer layer has been formed, the next operation can start with the electrophotographic process. Further the transfer layer acts to protect the light-sensitive layer and prevent the properties of the light-sensitive layer from deteriorating due to environmental influence.

Figure 3:
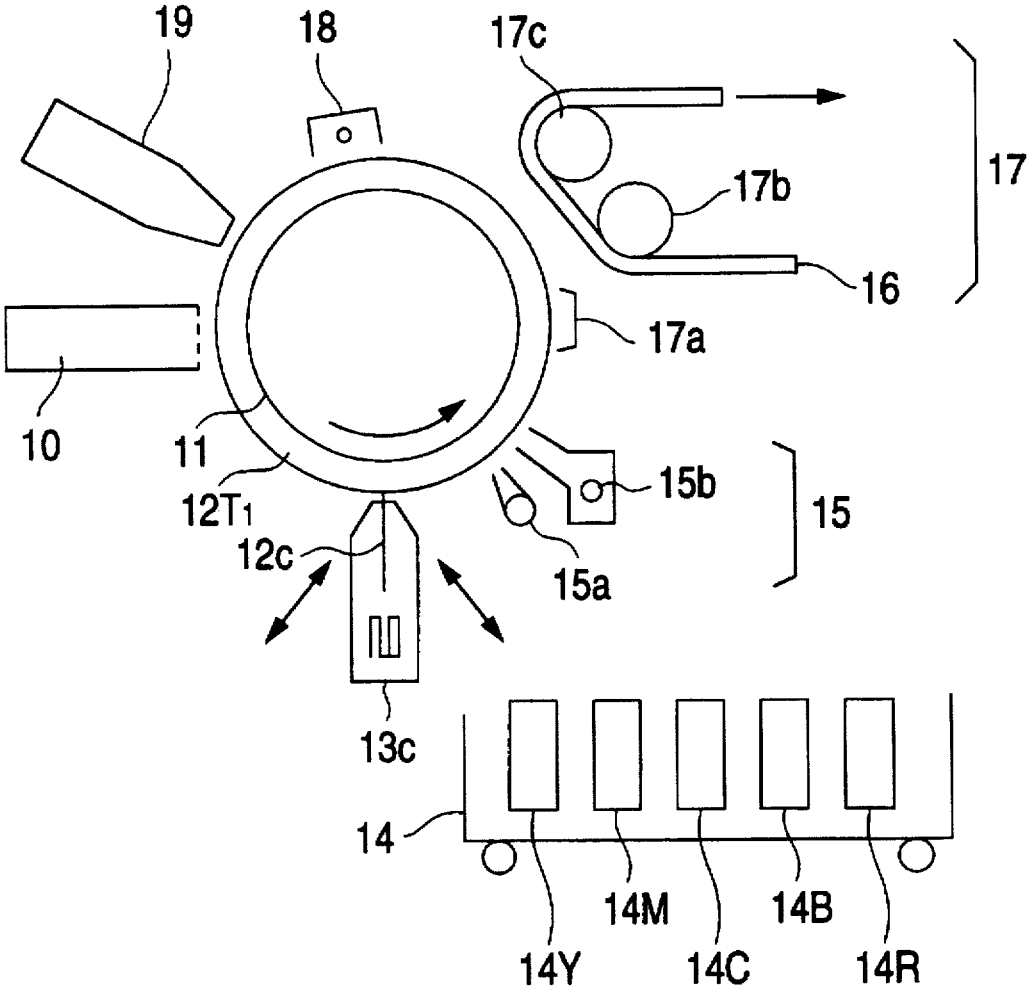
FIG. 3 is a schematic view of an electrophotographic color image-forming apparatus suitable for performing the method according to the present invention in which a hot-melt coating method is used for the formation of second transfer layer ($T_2$).

Another example of color image forming apparatus suitable for conducting the method of the present invention is schematically shown in FIG. 3 wherein the second transfer layer ($T_2$) is formed by the hot-melt coating method.

In FIG. 3, a thermoplastic resin 12*c* for the second transfer layer is coated on the first transfer layer ($T_1$) 12$T_1$ formed on the light-sensitive element 11 provided on a peripheral surface of drum by a hot-melt coater 13*c* and is caused to pass under a suction/exhaust unit 15 to be cooled to a predetermined temperature to form the second transfer layer ($T_2$).

After moving the hot-melt coater 13*c* to a stand-by-position, a liquid developing unit set 14 is positioned to initiate the electrophotographic process. The procedures followed are substantially same as those described in FIG. 2 above.

Figure 4:
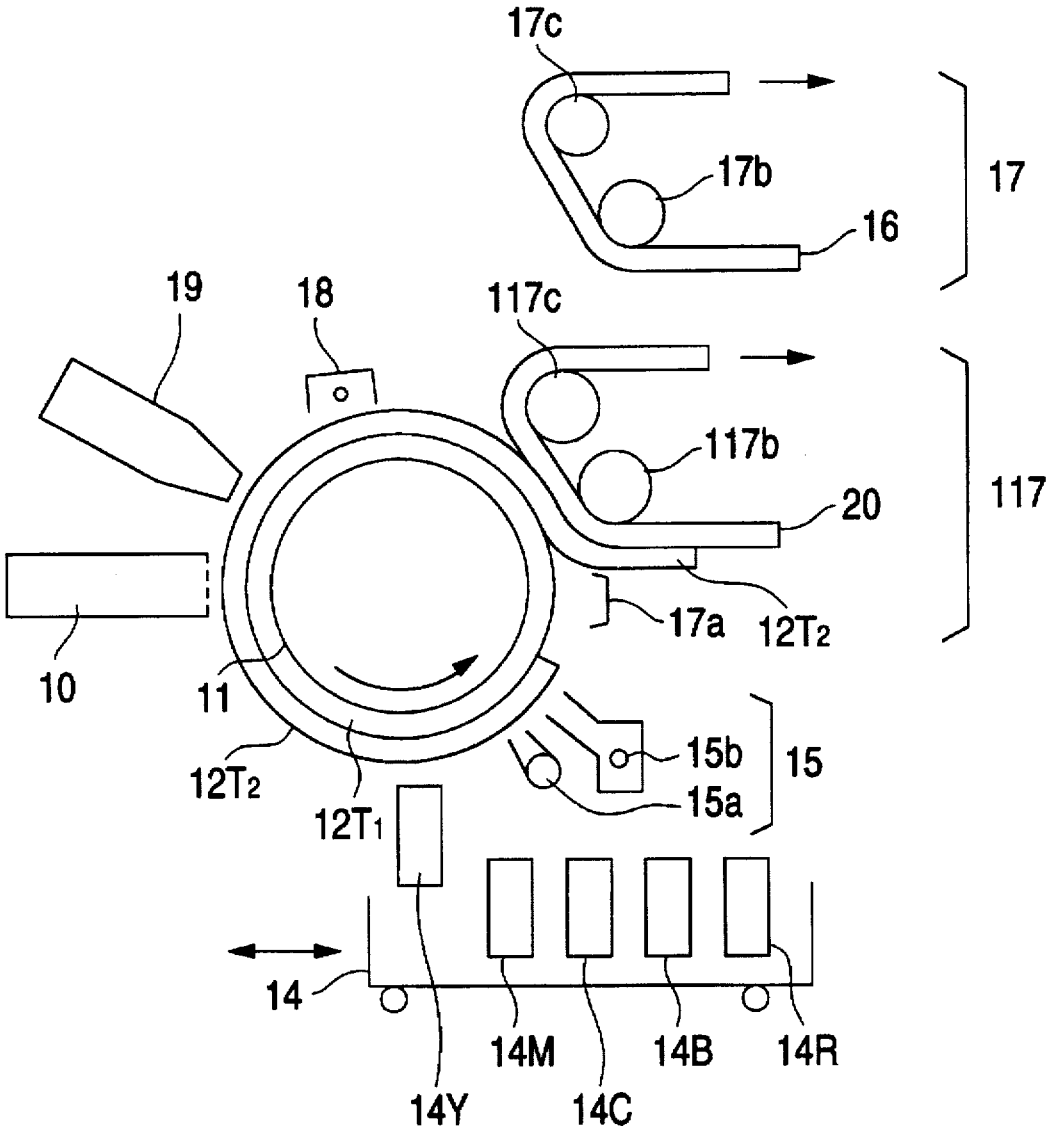
FIG. 4 is a schematic view of an electrophotographic color image-forming apparatus suitable for performing the method according to the present invention in which a transfer method from a releasable support is used for the formation of second transfer layer ($T_2$).

A still another example of color image forming apparatus suitable for conducting the method of the present invention is schematically shown in FIG. 4 wherein the second transfer layer ($T_2$) is formed by the transfer method.

In FIG. 4, the second transfer layer ($T_2$) 12$T_2$ is simply formed on the first transfer layer ($T_1$) 12$T_1$ provided on the light-sensitive element 11 by a transfer unit to light-sensitive element 117. Specifically, release paper 20 having thereon the second transfer layer ($T_2$) $12T_2$ is heat-pressed on the first transfer layer ($T_1$) $12T_1$ by a heating roller 117b, thereby the second transfer layer ($T_2$) $12T_2$ being transferred on the surface of first transfer layer ($T_1$) $12T_1$. Release paper 20 is cooled by cooling roller 117c and recovered. The light-sensitive element 11 is heated by heating means 17a to improve transferability of the second transfer layer ($T_2$) $12T_2$ upon heat-press, if desired.

The position of transfer unit to light-sensitive element 117 to be provided in the apparatus is not particularly limited. It may be movable and be replaced with a transfer unit to receiving material 17 for transfer of the transfer layers ($T_1$) $12T_1$ and ($T_2$) $12T_2$ to a receiving material 16. Alternatively, the transfer unit 117 is first employed to transfer the second transfer layer ($T_2$) $12T_2$ onto the first transfer layer ($T_1$) $12T_1$ and then used for transfer the transfer layers ($T_1$) $12T_1$ and ($T_2$) $12T_2$ onto a receiving material 16.

In the apparatus of FIGS. 3 and 4, other constructions are essentially same as those of the apparatus shown in FIG. 2.

In accordance with the method of forming a color image by an electrophotographic processing of the present invention, color images of high accuracy and high quality without color shear can be obtained in a simple and stable manner. Also, good color duplicates are obtained at a low temperature of transfer or a high speed of transfer irrespective of the kind of receiving material. Further, color duplicates obtained are excellent in retouching property, sealing property and filing property.

The present invention is illustrated in greater detail with reference to the following examples, but the present invention is not to be construed as being limited thereto.

SYNTHESIS EXAMPLE 1 OF RESIN GRAIN (AR): (AR-1)

A mixture of 12 g of Dispersion Stabilizing Resin (Q-1) having the structure shown below, 70 g of vinyl acetate, 30 g of vinyl butyrate and 388 g of Isopar H was heated to a temperature of 80° C. under nitrogen gas stream while stirring. To the solution was added 1.5 g of 2,2'-azobis (isobutyronitrile) (abbreviated as AIBN) as a polymerization initiator, followed by reacting for 2 hours. To the reaction mixture was added 0.8 g of AIBN was added thereto, followed by reacting for 2 hours. Further, 0.8 g of AIBN was added thereto, followed by reacting for 2 hours. After cooling the reaction mixture was passed through a nylon cloth of 200 mesh to obtain a white dispersion which was a latex of good monodispersity with a polymerization rate of 93% and an average grain diameter of 0.18 μm. The grain diameter was measured by CAPA-500 manufactured by Horiba Ltd. (hereinafter the same).

A part of the above-described white dispersion was centrifuged at a rotation of $1\times10^4$ r.p.m. for 60 minutes and the resin grains precipitated were collected and dried. A weight average molecular weight (Mw) of the resin grain measured by a GPL method and calculated in terms of polystyrene (hereinafter the same) was $8\times10^4$ and a glass transition point (Tg) thereof was 18° C.

The resin grain thus-obtained is designated as Resin Grain (RL-1).

A mixed solution of the whole amount of the above-described resin grain dispersion (as seed) and 10 g of Dispersion Stabilizing Resin (Q-2) having the structure shown below was heated to a temperature of 60° C. under nitrogen gas stream with stirring. To the mixture was added dropwise a mixture of 60 g of methyl methacrylate, 40 g of methyl acrylate, 2.0 g of methyl 3-mercaptopropionate, 0.8 g of 2,2'-azobis(isovaleronitrile) (abbreviated as AIVN) and 400 g of isopar G over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization rate of 98% and an average grain diameter of 0.25 μm.

Dispersion Stabilizing Resin

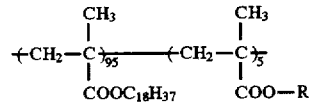

(Q-1)R: $\text{-}(CH_2)_2OCO(CH_2)_2COOCH{=}CH_2$ Mw $4\times10^4$ (Q-2)R: $\text{-}(CH_2)_5OCO(CH_2)_2COO(CH_2)_2OOC{-}C(CH_3){=}CH_2$ Mw $5\times10^4$ In order to investigate that the resin grain (AR-1) thus-obtained was composed of the two kinds of resins, the state of resin grain was observed using a scanning electron microscope (SEM).

Specifically, the dispersion of Resin Grain (AR-1) was applied to a polyethylene terephthalate film so that the resin grains were present in a dispersive state on the film, followed by heating at a temperature of 20° C. or 50° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 20° C. On the contrary, with the sample heated at 50° C. the resin grains had been melted by heating and were not observed.

The state of resin grain was observed in the same manner as described above with respect to resin grains formed from respective two kinds of resins (copolymers) constituting Resin Grain (AR-1), i.e., Resin Grain (RL-1) having a Tg of 18° C. and Resin Grain (RL-2) having a Tg of 45° C. described below, and a mixture of these resin grains in a weight ratio of 1:1.

As a result, it was found that with Resin Grain (RL-1), the resin grains were not observed in the sample heated at 20° C., although the resin grains were observed in the sample before heating. On the other hand, with Resin Grain (RL-2), the resin grains were not observed in the sample heated at 50° C. Further, with the mixture of two kinds of resin grains, disappearance of the resin grains was observed in the sample heated at 20° C. in comparison with the sample before heating.

From these results it was confirmed that Resin Grain (AR-1) described above was not a mixture of two kinds of resin grains but contained two kinds of resins therein, and had a core/shell structure wherein the resin having a relatively high Tg formed shell portion and the resin having a relatively low Tg formed core portion.

Preparation of Resin Grain (RL-2)

A mixed solution of 18 g of Dispersion Stabilizing Resin (Q-2) described above and 553 g of Isopar H was heated to a temperature of 55° C. under nitrogen gas stream while stirring. To the solution was added dropwise a mixture of 60 g of methyl methacrylate, 40 g of methyl acrylate, 1.3 g of methyl 3-mercaptopropionate and 1.0 g AIVN over a period of 60 minutes, followed by reacting for 1.5 hours. To the reaction mixture was further added 0.8 g of AIVN, followed by reacting for 2 hours. Then, 0.8 g of AIBN was added thereto and the temperature was adjusted to 80° C., and the reaction was continued for 2 hours. To the reaction mixture was further added 0.5 g of AIBN, followed by reacting for 2 hours.

After cooling, the reaction mixture was passed through a nylon cloth of 200 mesh to obtain a white dispersion which was a latex of good monodispersity with a polymerization rate of 99% and an average grain diameter of 0.15 μm. An Mw of the resin grain was $1.5\times10^4$ and a Tg thereof was 45° C.

SYNTHESIS EXAMPLES 2 TO 8 OF RESIN GRAIN (AR): (AR-2) TO (AR-8)

Each of Resin Grains (AR-2) to (AR-8) was synthesized in the same manner as in Synthesis Example 1 of Resin Grain (AR) except for using each of the monomers shown in Table A below in place of the monomers employed in Synthesis Example 1 of Resin Grain (AR). A polymerization rate of each of the resin grains obtained in latexes was in a range of from 95% to 99% and an average grain diameter thereof was in a range of from 0.20 μm to 0.30 μm with good monodispersity.

TABLE A

| Synthesis Example of Resin Grain (AR) | Resin Grain (AR) | Monomer for Seed Grain | Amount (g) | Monomer for Feeding | Amount (g) |
|---|---|---|---|---|---|
| 2 | AR-2 | Methyl methacrylate | 60 | Methyl methacrylate | 70 |
| | | Butyl acrylate | 40 | 2-Propoxyethyl methacrylate | 30 |
| 3 | AR-3 | Methyl methacrylate | 30 | Vinyl acetate | 100 |
| | | 2-Hexyloxyethyl methacrylate | 70 | | |
| 4 | AR-4 | Phenethyl methacrylate | 50 | Methyl methacrylate | 60 |
| | | 2-Butoxyethyl methacrylate | 50 | 2-(2-Butoxyethyloxy)ethyl methacrylate | 40 |
| 5 | AR-5 | Vinyl acetate | 80 | Methyl methacrylate | 50 |
| | | Vinyl valerate | 20 | 2-(2-Ethoxyethyloxy)ethyl methacrylate | 50 |
| 6 | AR-6 | Methyl methacrylate | 60 | 3-Phenylpropyl methacrylate | 70 |
| | | 2,3-Dibutyroyloxypropyl methacrylate | 40 | 3-Propoxypropyl methacrylate | 30 |
| 7 | AR-7 | Methyl methacrylate | 40 | 2,3-Dipropionyloxypropyl methacrylate | 40 |
| | | 2-Butoxycarbonylethyl methacrylate | 60 | Methyl methacrylate | 60 |
| 8 | AR-8 | Decyl methacrylate | 30 | Ethyl methacrylate | 65 |
| | | Methyl methacrylate | 70 | 2-Ethoxyethyl methacrylate | 35 |

SYNTHESIS EXAMPLE 9 OF RESIN GRAIN (AR): (AR-9)

A mixture of 20 g of Dispersion Stabilizing Resin (Q-1) described above, 60 g of vinyl acetate, 40 g of vinyl valerate and 388 g of Isopar H was heated to a temperature of 80° C. under nitrogen gas stream while stirring. To the solution was added 1.5 g of AIBN as a polymerization initiator, followed by reacting for 2 hours. To the reaction mixture was added 0.8 g of AIBN, followed by reacting for 2 hours. Further, 0.8 g of AIBN was added thereto, followed by reacting for 2 hours. After cooling the reaction mixture was passed through a nylon cloth of 200 mesh to obtain a white dispersion which was a latex of good monodispersity with a polymerization rate of 95% and an average grain diameter of 0.14 μm.

A mixture of the whole amount of the above-described resin grain dispersion, 10 g of Dispersion Stabilizing Resin (Q-3) having the structure shown below, 10 g of a dimethylsiloxane macromonomer (FM-0725 manufactured of Chisso Corp.) (Macromonomer (M-1)) and 200 g of Isopar H was heated to a temperature of 50° C. under nitrogen gas stream while stirring.

Dispersion Stabilizing Resin (Q-3)

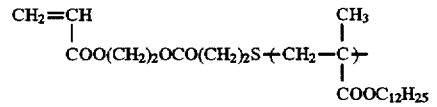

Mw $1.5\times10^4$

To the mixture was added dropwise a mixture of 70 g of benzyl methacrylate, 30 g of 2-ethylhexyl acrylate, 1.3 g of methyl 3-mercaptopropionate and 1.0 g of 2,2'-azobis(2-cyclopropylpropionitrile) (abbreviated as ACPP) over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of AIVN, followed by reacting for 2 hours. After cooling, the reaction mixture was passed through a nylon cloth of 200 mesh to obtain a white dispersion which was a latex of good monodispersity with a polymerization rate of 99% and an average grain diameter of 0.19 μm.

SYNTHESIS EXAMPLES 10 TO 14 OF RESIN GRAIN (AR): (AR-10) TO (AR-14)

Each of the resin grains (AR-10) to (AR-14) was synthesized in the same manner as in Synthesis Example 9 of Resin Grain (AR) except for using each of the macromonomers (Mw being in a range of from $8\times10^3$ to $1\times10^4$) shown in Table B below in place of 10 g of Macromonomer (M-1) employed in Synthesis Example 9 of Resin Grain (AR). A polymerization rate of each of the resin grains was in a range of from 98% to 99% and an average grain diameter thereof was in a range of from 0.15 μm to 0.25 μm with good monodispersity of a narrow size distribution.

TABLE B

| Synthesis Example of Resin Grain (AR) | Resin Grain (AR) | Macromonomer |
|---|---|---|
| 10 | AR-10 | (M-2) $CH_2=C(CH_3)-COO(CH_2)_2OCOCH_2S-[CH_2-C(CH_3)(COOCH_2CF_2CF_2H)]-$ |
| 11 | AR-11 | (M-3) $CH_2=CH-COO(CH_2)_2OCO(CH_2)_2S-[CH_2-C(CH_3)(COO(CH_2)_3Si(OSi(CH_3)_3)-CH_3)]-OSi(CH_3)_3$ |
| 12 | AR-12 | (M-4) $CH_2=C(CH_3)-COO(CH_2)_2S-[CH_2-C(CH_3)(COO(CH_2)_2C_8F_{17})]-$ |
| 13 | AR-13 | (M-5) $CH_2=C(CH_3)-COO(CH_2)_2NHCOO(CH_2)_2S-[CH_2-C(CH_3)(COO(CH_2)_3Si(CH_3)_2)]-CH_2C_2F_5$ |
| 14 | AR-14 | (M-6) $CH_2=C(CH_3)-COO(CH_2)_2NH-[CH_2CH_2N(COC_7F_{15})]-CH_3$ |

SYNTHESIS EXAMPLE 15 OF RESIN GRAIN (AR): (AR-15)

A mixture of resins (A) comprising a vinyl acetate/ethylene (46/54 by weight ratio) copolymer (Evaflex 45X manufactured by Du Pont-Mitsui Polychemicals Co., Ltd.) having a Tg of −25° C. and polyvinyl acetate having a Tg of 38° C. in a weight ratio of 1:1 was melted and kneaded by a three-roll mill at a temperature of 120° C. and then pulverized by a trio-blender. A mixture of 5 g of the resulting coarse powder, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLES 16 TO 20 OF RESIN GRAIN (AR): (AR-16) TO (AR-20)

Each dispersion was prepared according to a wet type dispersion process in the same manner as in Synthesis Example 15 of Resin Grain (AR) except for using each of the compounds shown in Table C below in place of two kinds of the resins (A) employed in Synthesis Example 15 of Resin Grain (AR). An average grain diameter of each of the white dispersion obtained was in a range of from 0.3 μm to 0.6 μm.

TABLE C

| Synthesis Example of Resin Grain (AR) | Resin Grain (AR) | Resin |
|---|---|---|
| 16 | AR-16 | Mixture of cellulose acetate butyrate (Cellidor Bsp manufactured by Bayer AG) and vinyl acetate/crotonic acid (99/1 by weight ratio) copolymer in a weight ratio of 60:40 |
| 17 | AR-17 | Mixture of styrene/butadiene copolymer (Sorprene 1204 manufactured by Asahi Kasei Kogyo Kabushiki Kaisha) and styrene/vinyl acetate (20/80 by weight ratio) copolymer in a weight ratio of 50:50 |
| 18 | AR-18 | Mixture of polyvinyl butyral resin (S-Lec manufactured by Sekisui Chemical Co., Ltd.) and cellulose propionate (Cellidoria manufactured by Daicel Co., Ltd.) in a weight ratio of 70:30 |
| 19 | AR-19 | Mixture of polyester resin (Chemit R-185 manufactured by Toray Co., Ltd.) and methyl methacrylate/butyl acrylate (60/40 by weight ratio) AB block copolymer in a weight ratio |

TABLE C-continued

| Synthesis Example of Resin Grain (AR) | Resin Grain (AR) | Resin |
|---|---|---|
| | | of 50:50 |
| 20 | AR-20 | Mixture of polydecamethylene terephthalate and polypentamethylene carbonate in a weight ratio of 30:70 |

SYNTHESIS EXAMPLE 1 OF RESIN GRAIN ($AL_2R$): ($AL_2R$-1)

A mixed solution of 10 g of Dispersion Stabilizing Resin (Q-1) described above, 70 g of vinyl acetate, 30 g of vinyl propionate, and 384 g of Isopar H was heated to a temperature of 70° C. under nitrogen gas stream while stirring.

To the solution was added 0.8 g of AIVN as a polymerization initiator, followed by reacting for 3 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours. The temperature of reaction mixture was raised to 100° C. and stirred for 2 hours to remove the unreacted monomer by distillation. After cooling, the reaction mixture was passed through a nylon cloth of 200 mesh to obtain a white dispersion which was a latex of good monodispersity with a polymerization rate of 90% and an average grain diameter of 0.23 μm. An Mw of the resin grain was $8\times10^4$ and a Tg thereof was 28° C.

SYNTHESIS EXAMPLE 2 OF RESIN GRAIN ($AL_2R$): ($AL_2R$-2)

A mixed solution of 20 g of Dispersion Stabilizing Resin (Q-4) having the structure shown below and 382 g of Isopar G was heated to a temperature of 60° C. under nitrogen gas stream while stirring.

Dispersion Stabilizing Resin (Q-4)

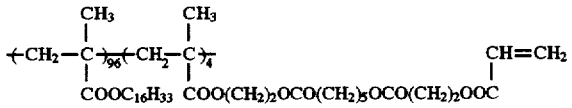

Mw $4\times10^4$

To the solution was added dropwise a mixture of 30 g of methyl methacrylate, 70 g of ethyl acrylate, 0.6 g of methyl 3-mercaptopropionate and 1.0 g of AIVN over a period of one hour, followed by reacting for one hour. To the reaction mixture was further added 0.8 g of AIVN, followed by reacting for 2 hours. Thus, 0.8 g of AIBN was added thereto and the temperature was adjusted to 80° C., and the reaction was continued for 2 hours. To the reaction mixture was further added 0.5 g of AIBN, followed by reacting for 2 hours. The temperature of reaction mixture was raised to 100° C. and the unreacted monomer was distilled off under a reduced pressure of 10 to 20 mmHg. After cooling, the reaction mixture was passed through a nylon cloth of 200 mesh to obtain a white dispersion which was a latex of good mono-dispersity with a polymerization rate of 98% and an average grain diameter of 0.17 μm. An Mw of the resin grain was $8\times10^4$ and a Tg thereof was 16° C.

SYNTHESIS EXAMPLES 3 TO 13 OF RESIN GRAIN ($AL_2R$): ($AL_2R$-3) TO ($AL_2R$-13)

Each of the resin grains ($AL_2R$) was synthesized in the same manner as in Synthesis Example 2 of Resin Grain ($AL_2R$) except for using each of the monomers shown in Table D below in place of 30 g of methyl methacrylate and 70 g of ethyl acrylate employed in Synthesis Example 2 of Resin Grain ($AL_2R$).

A polymerization rate of each of the resin grains was in a range of from 90% to 99% and an average grain diameter thereof was in a range of from 0.13 μm to 0.20 μm with good monodispersity.

TABLE D

| Synthesis Example of Resin Grain ($AL_2R$) | Resin Grain ($AL_2R$) | Monomer | Amount (g) |
|---|---|---|---|
| 3 | $AL_2R$-3 | Benzyl methacrylate | 60 |
| | | Ethyl acrylate | 40 |
| 4 | $AL_2R$-4 | Methyl methacrylate | 60 |
| | | 2-(2-Hexyloxyethyloxy)ethyl methacrylate | 40 |
| 5 | $AL_2R$-5 | Benzyl methacrylate | 50 |
| | | 2,3-Diethoxycarbonylpropyl methacrylate | 50 |
| 6 | $AL_2R$-6 | Ethyl methacrylate | 75 |
| | | 2-Methoxyethyl acrylate | 25 |
| 7 | $AL_2R$-7 | Propyl methacrylate | 80 |
| | | Methyl acrylate | 20 |
| 8 | $AL_2R$-8 | Methyl methacrylate | 40 |
| | | 1-Ethoxymethyl-2-ethoxyethyl methacrylate | 60 |
| 9 | $AL_2R$-9 | Phenethyl methacrylate | 70 |
| | | Ethyl acrylate | 30 |
| 10 | $AL_2R$-10 | Methyl methacrylate | 75 |
| | | Dodecyl methacrylate | 20 |
| | | Acrylic acid | 5 |
| 11 | $AL_2R$-11 | Vinyl acetate | 60 |
| | | Vinyl butyrate | 40 |
| 12 | $AL_2R$-12 | Vinyl acetate | 80 |
| | | Vinyl decanoate | 20 |
| 13 | $AL_2R$-13 | Benzyl methacrylate | 70 |
| | | Butyl acrylate | 30 |

SYNTHESIS EXAMPLE 1 OF RESIN GRAIN (PL): (PL-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of AIVN, followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm.

Monomer (LM-1)

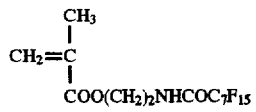

Dispersion Stabilizing Resin (LP-1)

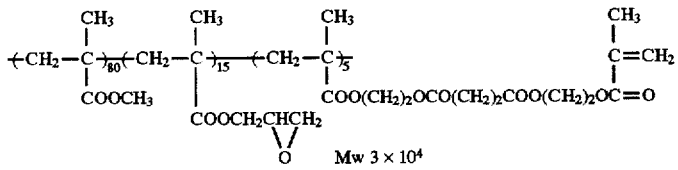

Mw $3 \times 10^4$

SYNTHESIS EXAMPLE 2 OF RESIN GRAIN (PL): (PL-2)

A mixed solution of 5 g of Dispersion Stabilizing Resin (LP-2) having the structure shown below and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

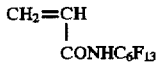

Dispersion Stabilizing Resin (LP-2)

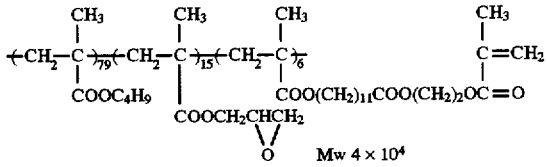

Mw $4 \times 10^4$

SYNTHESIS EXAMPLES 3 TO 6 OF RESIN GRAIN (PL): (PL-3) TO (PL-6)

Each of resin grains was synthesized in the same manner as in Synthesis Example 1 of Resin Grain (PL), except for replacing Monomer (LM-1), ethylene glycol dimethacrylate and methyl ethyl ketone with each of the compounds shown in Table E below, respectively. An average grain diameter of each of the resulting resin grains was in a range of from 0.15 to 0.30 μm.

TABLE E

| Synthesis Example of Resin Grain (PL) | Resin Grain (PL) | Monomer (LM) | Polyfunctional Monomer for Crosslinking | Reaction Amount | Reaction Solvent |
|---|---|---|---|---|---|
| 3 | PL-3 | (LM-3) 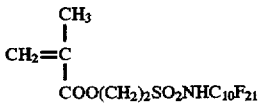 | Ethylene glycol dimethacrylate | 2.5 g | Methyl ethyl ketone |
| 4 | PL-4 | (LM-4) 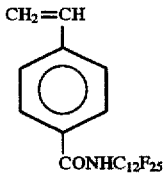 | Divinylbenzene | 3 g | Methyl ethyl ketone |
| 5 | PL-5 | (LM-5) 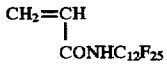 | — | | Methyl ethyl ketone |

TABLE E-continued

| Synthesis Example of Resin Grain (PL) | Resin Grain (PL) | Monomer (LM) | Polyfunctional Monomer for Crosslinking | Reaction Amount | Solvent |
|---|---|---|---|---|---|
| 6 | PL-6 | (LM-6) $CH_2{=}CH$ \| $COO(CH_2)_2CONHC_8F_{17}$ | Trimethylolpropane trimethacrylate | 2.5 g | Methyl ethyl ketone |

EXAMPLE 1

A mixture of 2 g of X-form metal-free phthalocyanine (manufactured by Dainippon Ink and Chemicals, inc.), 14.4 g of Binder Resin (B-1) having the structure shown below, 3.6 g of Binder Resin (B-2) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-1)

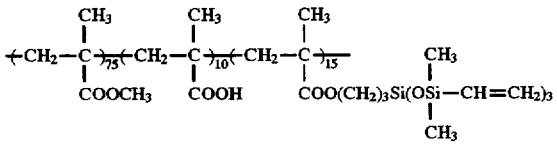

Mw $6\times10^4$ (weight ratio)

Binder Resin (B-2)

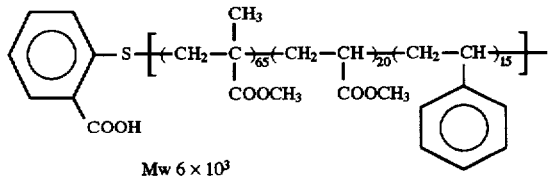

Mw $6\times10^3$

Compound (A)

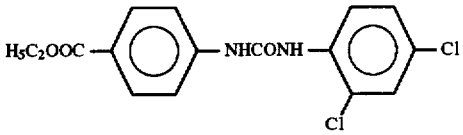

The resulting dispersion was coated on an aluminium plate having a thickness of 0.2 mm, which had been subjected to degrease treatment, by a wire bar, set to touch, and heated at 110° C. for 20 seconds to form a light-sensitive layer having a thickness of 8 μm.

Then, a surface layer for imparting releasability was provided on the light-sensitive layer. Specifically, a coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesive strength of the surface of the resulting light-sensitive element was not more than 1 g.f.

Silicone Resin

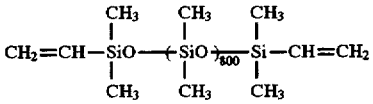

(presumptive structure)

Crosslinking Agent

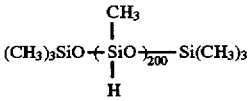

(presumptive structure)

Crosslinking Controller $CH{\equiv}C{-}Si(OCH_3)_3$

The electrophotographic light-sensitive element having the surface of releasability was installed in an apparatus as shown in FIG. 2, and a transfer layer was provided thereon. Specifically, on the surface of light-sensitive element installed on a drum, surface temperature of which was adjusted at 60° C. and which was rotated at a circumferential speed of 100 mm/sec, Dispersion of Resin Grain (L-1) containing positively charged resin grains shown below was supplied using a slit electrodeposition device as an electrodeposition unit 13*a*, while putting the light-sensitive element to earth and applying an electric voltage of +140 V to an electrode of the slit electrodeposition device, whereby the resin grains were electrodeposited and fixed. A thickness of the resulting first transfer layer ($T_1$) 12$T_1$ was 1.5 μm.

Dispersion of Resin Grain (L-1)

| | |
|---|---|
| Resin Grain (AR-1) | 10 g (solid basis) |
| Positive-Charge Control Agent (CD-1) (octadecyl vinyl ether/N-hexadecyl maleic monoamide copolymer (1/1 ratio by mole)) | 0.08 g |
| Charge adjuvant (dodecyl methacrylate/methacrylic acid copolymer (94/6 ratio by weight)) | 0.1 g |
| Isopar G | up to make 1.0 liter |

On the first transfer layer ($T_1$) was formed the second transfer layer ($T_2$) having a thickness of 1.0 μm in the same manner as above using Dispersion of Resin Grain (L-2) containing positively charged resin grains prepared in the same manner as in Dispersion of Resin Grain (L-1) except for using 10 g (solid basis) of Resin Grain ($AL_2R$-1) in place of 10 g of Resin Grain (AR-1).

The electrophotographic light-sensitive material thus-obtained was subjected to an electrophotographic process. Specifically, the light-sensitive element 11 having provided thereon the transfer layer was charged to +450 V with a corona charger 18 in dark and image-exposed to light using a semiconductor laser having an oscillation wavelength of 788 nm as an exposure device 19 at an irradiation dose on the light-sensitive material of 30 erg/cm$^2$, based on digital image data on an information for yellow color separation among digital image data on informations for yellow, magenta, cyan and black color separations which had been obtained by reading an original by a color scanner, conducting several corrections relating to color reproduction specific for color separation system and memorized in a hard disc.

Thereafter, the exposed light-sensitive material was subjected to reversal development using a liquid developer prepared by diluting a yellow liquid developer for Signature System (manufactured by Eastman Kodak Co.) with 75-fold by weight Isopar H (manufactured by Esso Standard Oil Co.) while a bias voltage of +350 V was applied to a yellow liquid developing unit 14Y to thereby electrodeposit toner particles on the exposed areas. The light-sensitive material was then rinsed in a bath of Isopar H alone to remove stains in the non-image areas, and dried by passing under a suction/exhaust unit 15 and a heating means 17*a*.

The above procedure was repeated using each information for magenta, cyan and black in place of the information for yellow to form four color toner images.

Then, coated paper was passed as a receiving material 16 between the drum of light-sensitive element having the transfer layer and toner image provided thereon, whose surface temperature had been adjusted at 60° C. and a backup roller for transfer 17*b* adjusted at 100° C. and then-a backup roller for release 17*c* whose temperature had not been controlled under a nip pressure of 4 kgf/cm$^2$ and at a drum circumferential speed of 150 mm/sec. The color toner images were wholly transferred onto the coated paper and thus a multicolor duplicate was obtained.

The duplicated image thus-formed on the coated paper was visually observed using an optical microscope of 200 magnifications. It was found that the image on the receiving material was excellent in that the non-image areas had no background stain due to toner and the image areas suffered no defect in high definition or highly accurate image regions such as cutting of fine lines, fine letters and dots for half tone areas of continuous gradation due to the complete transfer of toner image and transfer layer from the light-sensitive element to the coated paper without remainder.

Comparative Example 1

A single transfer layer composed of Resin Grain (AR-1) having a thickness of 2.5 μm was formed on the light-sensitive element in the same manner as in Example 1 in place of the stratified transfer layer of the first layer composed of Resin Grain (AR-1) and the second layer composed of Resin Grain ($AL_2R$-1) employed in Example 1. Then, the formation of toner image and transfer to coated paper were conducted in the same manner as in Example 1. It was observed that the transfer was not wholly conducted and cuttings of toner image were frequently found in the resulting color duplicate on coated paper.

Then, the transfer condition under which the complete transfer can be performed was investigated. As a result, it was found that a good color duplicate similar to that of Example 1 was obtained under the following condition:

| | |
|---|---|
| Surface temperature of light-sensitive drum | 100° C. |
| Temperature of backup roller for transfer | 130° C. |
| Drum circumferential speed | 30 mm/sec |
| Nip pressure | 6 Kgf/cm$^2$ |

Comparative Example 2

A stratified transfer layer having a thickness of 2.5 μm in total was formed on the light-sensitive element in the same manner as in Example 1 except for using a mixture of each 5 g (solid basis) of Resin Grains (RL-1) and (RL-2) described above in place of Resin Grain (AR-1) in Dispersion of Resin Grain (L-1) for the first transfer layer employed in Example 1. Then, the formation of toner image and transfer to coated paper were conducted in the same manner as in Example 1. It was observed that the transfer was not wholly conducted and cuttings of toner image were frequently found in the resulting color duplicate on coated paper.

Then, the transfer condition under which the complete transfer can be performed was investigated. As a result, it was found that a good color duplicate similar to that of Example 1 was obtained under the following condition:

| | |
|---|---|
| Surface temperature of light-sensitive drum | 80° C. |
| Temperature of backup roller for transfer | 100° C. |
| Drum circumferential speed | 50 mm/sec |
| Nip pressure | 4 Kgf/cm$^2$ |

From these results it can be seen that the method according to the present invention has advantages in that the release of toner image from the light-sensitive element is sufficiently performed and a problem of cuttings of toner image does not occur and in that the color duplicate obtained is excellent in storage stability since the toner image sufficiently adheres to the transfer layer on the receiving material.

Also, the color duplicate had good retouching property by a pencil or ball-point pen, sealing property and filing property between sheets of plastic film such as vinyl chloride film similar to those of plain paper.

Further, duplications of color image were conducted using high quality paper, copying paper for PPC, plain paper, and a PET film as receiving materials, respectively, in place of coated paper. On each of these receiving materials, duplicated images of good image quality similar to those on coated paper as in Example 1 were obtained. Good and stable color duplicates are easily obtained according to the method of present invention even when various receiving materials which are different in surface smoothness and composition thereof.

Example 2

An amorphous silicon electrophotographic light-sensitive element (manufactured by KYOSERA Corp.) was installed in an apparatus as shown in FIG. 4 as a light-sensitive element. The adhesive strength of the surface of light-sensitive element was 230 g.f.

Impartation of releasability to the light-sensitive element was conducted by dipping the light-sensitive element in a solution of the compound (S) according to the present invention (dip method) in the apparatus. Specifically, the light-sensitive element rotated at a circumferential speed of 10 mm/sec was brought into contact with a bath containing a solution prepared by dissolving 1.0 g of Compound (S-1) shown below in one liter of Isopar G (manufactured by Esso Standard Oil Co.) for 7 seconds and dried using air-squeezing. The adhesive strength of the surface of light-sensitive element thus-treated was 3 g.f and the light-sensitive element exhibited good releasability.

Compound (S-1)

Silicone surface active agent (SILWet FZ-2171 manufactured by Nippon Unicar Co., Ltd.)

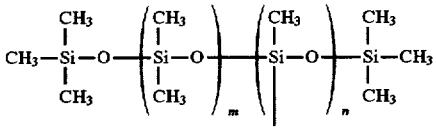

(presumptive structure) $C_3H_6(OC_2H_4)_a(OC_3H_6)_bOH$

On the surface of light-sensitive element which was rotated at a circumferential speed of 100 mm/sec, Dispersion of Resin Grain (L-3) containing positively charged resin grains shown below was supplied using a slit electrodeposition device, while putting the light-sensitive element to earth and applying an electric voltage of +130 V to an electrode of the slit electrodeposition device to cause the grains to electrodeposit and fix. A thickness of the resulting first transfer layer ($T_1$) was 1.0 μm.

Dispersion of Resin Grain (L-3)

| | |
|---|---|
| Resin Grain (AR-3) | 10 g (solid basis) |
| Positive-Charge Control Agent (CD-2) (1-hexadecene/N-decylmaleic monoamide copolymer (1/1 ratio by mole)) | 0.09 g |
| Branched tetradecyl alcohol (FOC-1400 manufactured by Nissan Chemical Industries, Ltd.) | 5 g |
| Isopar G | up to make 1.0 liter |

On the first transfer layer ($T_1$) was formed a second transfer layer ($T_2$) by the transfer method from release paper. Specifically, on Separate Shi (manufactured by Oji Paper Co., Ltd.) as release paper 20 was coated vinyl acetate/vinyl propionate (75/25 ratio by weight) copolymer as resin ($AL_2$) at a thickness of 1.5 μm. The resulting paper was supplied from a transfer unit to light-sensitive element 117 and brought into contact with the above-described light-sensitive element 11 having the first transfer layer ($T_1$) 12$T_1$ under condition of a nip pressure of roller of 3 Kgf/cm$^2$, a surface temperature of roller of 80° C. and a transportation speed of 50 mm/sec whereby the second transfer layer ($T_2$) having a thickness of 1.5 μm was formed on the first transfer layer ($T_1$).

The resulting light-sensitive element having provided thereon the transfer layer was charged to 30 700 V with a corona discharge in dark and exposed to light using a semiconductor laser having an oscillation wavelength of 780 nm at an irradiation dose on the surface of the light-sensitive element of 25 erg/cm$^2$ on the basis of digital image data on an information for yellow color separation same as in Example 1. A residual potential in the exposed area was +120 V. The exposed light-sensitive element was then subjected to reversal development by supplying a liquid developer prepared by diluting a yellow toner for an electrostatic color plotter (Versateck 3000 manufactured by Xerox Corp.) with 50-fold isopar H (manufactured by Esso Standard Oil Co.) from a developing unit to the surface of light-sensitive element while applying a bias voltage of +300 V to the developing unit side to thereby electrodeposit yellow toner particles on the exposed areas. The light-sensitive element was then rinsed in a bath of Isopar H alone to remove stains in the non-image areas and dried.

The above procedure was repeated using each information for magenta, cyan and black in place of the information for yellow to form color toner images.

Then, high quality paper was passed between the drum of light-sensitive element having the transfer layer and toner image provided thereon, whose surface temperature had been adjusted at 60° C. and a rubber transfer roller adjusted at a surface temperature of 120° C. under a nip pressure of 4 Kgf/cm$^2$ and at a transportation speed of 100 mm/sec and then separated from the light-sensitive element, whereby the toner image was transferred together with the transfer layer to the high quality paper.

The duplicated images formed on the high quality paper was visually observed using an optical microscope of 200 magnifications. It was found that the images on the receiving material was excellent in that the non-image areas had no background stain due to toner and the image areas suffered no defect in high definition or highly accurate image regions such as cutting of fine lines, fine letters and dots for half tone areas of continuous gradation due to the complete transfer of toner image and transfer layer from the light-sensitive element to the high quality paper without remainder. The color duplicate obtained had good mechanical strength, retouching property and sealing property.

Example 3

A color duplicate was obtained in the same manner as in Example 1 except for using the hot-melt coating method as described below with reference to FIG. 3 in place of the electrodeposition coating method for the formation of second transfer layer ($T_2$).

Formation of Second Transfer Layer ($T_2$)

Resin ($AL_2$-1) having the structure shown below was coated on the first transfer layer ($T_1$) 12$T_1$ at a rate of 20 mm/sec by a hot melt coater 13*c* adjusted at 110° C. and cooled by blowing cool air from a suction/exhaust unit 15, followed by maintaining the surface temperature at 30° C. to prepare the second transfer layer ($T_2$) having a thickness of 2.0 μm.

Resin ($AL_2$-1)

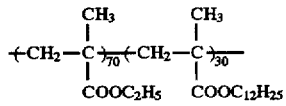

Mw $2\times10^4$

The duplicated image thus-formed on the coated paper was visually observed using an optical microscope of 200 magnifications. It was found that the image on the receiving material was excellent in that the non-image areas had no background stain due to toner and the image areas suffered no defect in high definition or highly accurate image regions such as cutting of fine lines, fine letters and dots for half tone areas of continuous gradation due to the complete transfer of toner image and transfer layer from the light-sensitive element to the coated paper without remainder.

EXAMPLES 4 TO 13

Color duplicates were formed in the same manner as in Example 1 except for using each of the resin grains shown in Table F below in place of the resin grains employed for the first transfer layer ($T_1$) and second transfer layer ($T_2$) respectively.

TABLE F

| Example | First Transfer Layer ($T_1$)/ Second Transfer Layer ($T_2$) |
|---|---|
| 4 | AR-2/$AL_2$R-3 |
| 5 | AR-3/$AL_2$R-4 |
| 6 | AR-4/$AL_2$R-5 |
| 7 | AR-5/$AL_2$R-6 |
| 8 | AR-9/$AL_2$R-7 |
| 9 | AR-8/$AL_2$R-8 |
| 10 | AR-10/$AL_2$R-9 |
| 11 | AR-12/$AL_2$R-10 |
| 12 | AR-15/$AL_2$R-11 |
| 13 | AR-19/$AL_2$R-13 |

The color duplicates obtained had clear images free from background stains. Specifically, the toner images formed on the light-sensitive element had good reproducibility and no fog in the non-image portion, and were wholly transferred together with the transfer layer to coated paper without the formation of unevenness. Further, on the duplicates, retouching and sealing were made same as on plain paper.

EXAMPLES 14 TO 16

Color duplicates were formed in the same manner as in Example 2 except for using release paper (Sanrelease manufactured by Sanyo-Kokusaku Pulp Co., Ltd.) in place of Separate Shi and a transfer layer having a thickness of 1.0 μm composed of each of the resins ($AL_2$) shown in Table G below in place of the copolymer for the second transfer layer ($T_2$) used in Example 2.

TABLE G

| Example | Resin ($AL_2$) |
|---|---|
| 14 | Mixture of vinyl acetate/vinyl butyrate (8/2 by weight) copolymer and phenethyl methacrylate/butyl acrylate (8/2 by weight) copolymer in a weight ratio of 60/40 |
| 15 | Mixture of resin shown below and Evaflex 45X (manufactured by Du Pont-Mitsui Polychemicals Co., Ltd.) in a weight ratio of 70/30 |

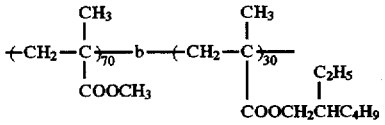

Mw $4\times10^4$ —b—: bond connecting blocks

| | |
|---|---|
| 16 | Mixture of resin shown below and polyvinyl acetate in a weight ratio of 50/50 |

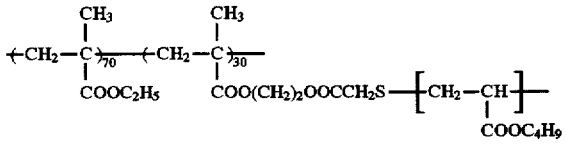

Mw $4\times10^4$ (Mw of graft portion $6\times10^3$)

The color duplicate obtained were clear and free from background stain, and degradation of image quality was not substantially observed when compared with the original.

These results illustrate that in a case wherein the second transfer layer is formed on the first transfer layer by the transfer method using release paper and transferred onto high quality paper, the transfer layer is uniformly and completely transferred at each transfer step without any adverse effect on image quality.

EXAMPLES 17 TO 19

The procedure for the formation of-transfer image same as in Example 3 was repeated except that each of the resins shown in Table H below was used in place of Resin ($AL_2$-1) used for the formation of second transfer layer ($T_2$) in Example 3.

TABLE H

| Example | Resin ($AL_2$) |
|---|---|
| 17 | Methyl methacrylate/hexyl acrylate (50/50) by weight) copolymer |
| 18 | Ethylene/dodecyl methacrylate (70/30 by weight) copolymer |
| 19 | Vinyl acetate/vinyl valerate/vinyl acetic acid (70/25/5 by weight) copolymer |

The color duplicate obtained were clear and free from background stain, and degradation of image quality was not substantially observed when compared with the original.

These results illustrate that in a case wherein the second transfer layer is formed on the first transfer layer by the hot-melt coating method and transferred onto high quality paper, the transfer layer is uniformly and completely transferred without any adverse effect on image quality.

EXAMPLE 20

A mixture of 2 g of X-form metal-free phthalocyanine, 14 g of Binder Resin (B-3) having the structure shown below, 4 g of Resin (P-1) for imparting releasability having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 0.02 g of phthalic anhydride and 0.005 g of zirconium acetylacetone, followed by dispersion for one minute. The glass beads were separated by filtration to prepare a dispersion for a light-sensitive layer.

Binder Resin (B-3).

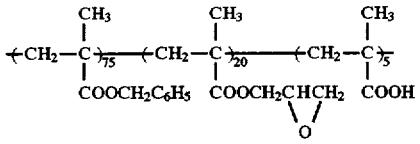

Mw $5\times10^4$

Resin (P-1).

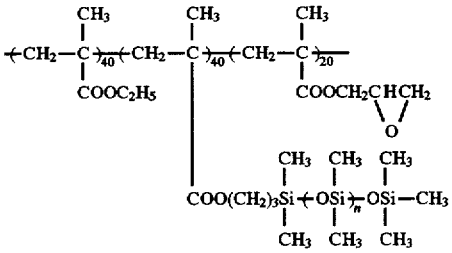

The resulting dispersion was coated on an aluminum plate having a thickness of 0.2 mm, which had been subjected to degrease treatment, by a wire bar, set to touch, and heated in a circulating oven at 110° C. for 20 minutes and then at 140° C. for one hour to form a light-sensitive layer having a thickness of 8 μm. The adhesive strength of the surface of electrophotographic light-sensitive element was 1 g.f.

For comparison, an electrophotographic light-sensitive element was prepared in the same manner as described above except for eliminating 4 g of Resin (P-1). The adhesive strength of the surface thereof was more than 400 g.f and did not exhibit releasability at all.

Using the electrophotographic light-sensitive element of the present invention described above, the formation of color duplicate was performed in the same manner as in Example 1. The color duplicate obtained was clear and free from background stain. The residual transfer layer and toner image was not recognized on the light-sensitive element at all.

EXAMPLE 21

5 g of 4,4'-bis(diethylamino)-2,2'-dimethyltriphenylmethane as an organic photoconductive substance, 4 g of Binder Resin (B-4) having the structure shown below, 1.2 g of Resin (P-2) having the structure shown below, 40 mg of Dye (D-1) having the structure shown below, and 0.2 g of Anilide Compound (B) having the structure shown below as a chemical sensitizer were dissolved in a mixed solvent of 30 ml of methylene chloride and 30 ml of ethylene chloride to prepare a solution for light-sensitive layer.

Binder Resin (B-4)

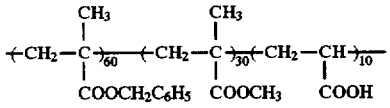

Mw $8\times10^4$

Resin (P-2)

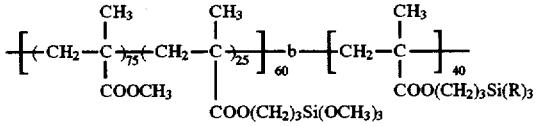

(R: $-OSi(CH_3)_3$)

Mw $6\times10^4$ (—b—: bond connecting blocks)

Dye (D-1)

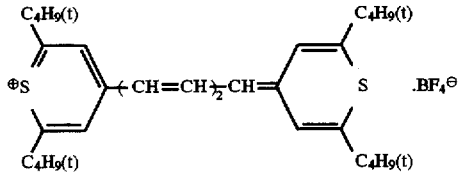

Anilide Compound (B)

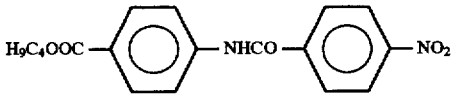

The resulting solution for light-sensitive layer was coated on a conductive transparent substrate composed of a 100 μm thick polyethylene terephthalate film having a deposited layer of indium oxide thereon (surface resistivity: $10^3\Omega$) by a wire round rod, set to touch, and heated at 80° C. for one hour to prepare a light-sensitive element having an organic light-sensitive layer having a thickness of 6 μm. The adhesive strength of the surface of light-sensitive element was 2 g.f.

The procedure same as in Example 1 was repeated except for using the resulting light-sensitive element and plain paper to prepare a color duplicate. The color image obtained on plain paper was clear and free from background stain and had good image strength.

The good results similar to these above was obtained in the same procedure as described above except for using 2 g of Resin Grain (PL-1) in place of 1.2 g of Resin (P-2).

EXAMPLES 22 TO 24

A mixture of 5 g of a bisazo pigment having the structure shown below, 95 g of tetrahydrofuran and 5 g of a polyester resin (Vylon 200 manufactured by Toyoho Co., Ltd.) was thoroughly pulverized in a ball mill. To the mixture was added 520 g of tetrahydrofuran with stirring. The resulting dispersion was coated on a conductive transparent substrate used in Example 21 by a wire round rod to prepare a charge generating layer having a thickness of about 0.7 μm.

Bisazo Pigment

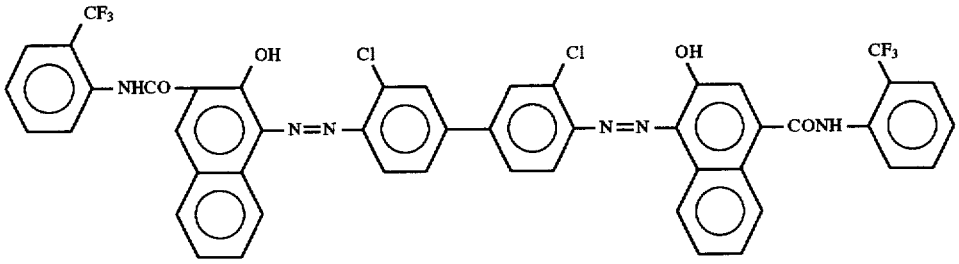

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

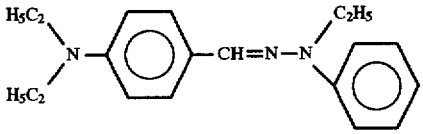

A mixed solution of 13 g of each of Resins (P) shown in Table I below, 0.2 g of phthalic anhydride, 0.002 g of o-chlorophenol and 100 g of toluene was coated on the light-sensitive layer at a dry thickness of 1 μm by a wire round rod, set to touch and heated at 140° C. for one hour to prepare a surface layer for imparting releasability. The adhesive strength of the surface of the resulting light-sensitive element was not more than 2 g.f.

The resulting light-sensitive element was charged to a surface potential of −500 V in dark and exposed imagewise using a helium-neon laser of 633 nm at an irradiation dose on the surface of the light-sensitive element of 30 erg/cm$^2$, followed by conducting according to the procedure as in Example 1 to form a color duplicate. Each color duplicate thus-obtained exhibited good characteristics similar to those in Example 1.

TABLE I

| Example | Resin (P) |
|---|---|
| 22 | 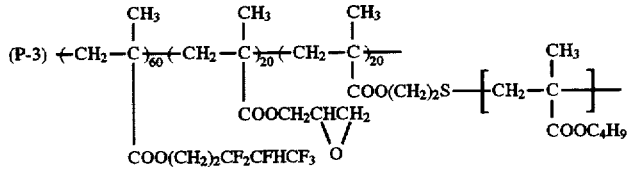 Mw 6 × 10$^4$ (Mw of graft polymer 1 × 10$^4$) |
| 23 | 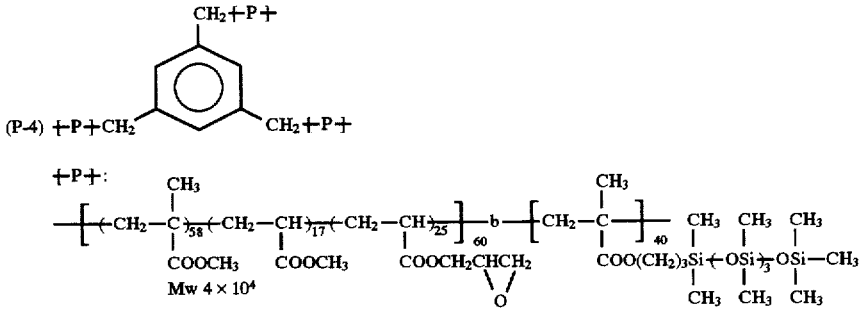 |

TABLE I-continued

| Example | Resin (P) |
|---|---|
| 24 | (P-5) 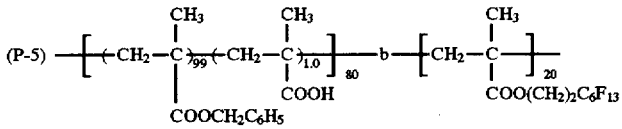 |

EXAMPLE 25

A mixture of 100 g of photoconductive zinc oxide, 24 g of Binder Resin (B-5) having the structure shown below, 5 g of Binder Resin (B-6) having the structure shown below, 3 g of Resin (P-6) having the structure shown below, 1 g of Resin Grain (PL-2), 0.01 g of Dye (D-2) having the structure shown below, 0.1 g of salicylic acid and 150 g of toluene was dispersed by a homogenizer (manufactured by Nippon Seiki K.K.) at a rotation of $1\times10^4$ r.p.m. for 15 minutes to prepare a dispersion for a light-sensitive layer.

Binder Resin (B-5)

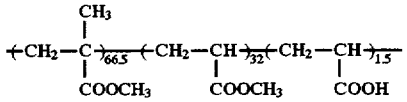

Mw $6.8\times10^4$

Binder Resin (B-6)

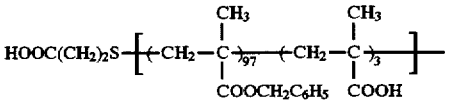

Mw $8\times10^3$

Resin (P-6)

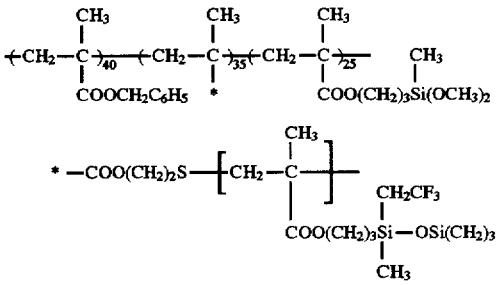

Mw $4\times10^4$ (Mw of graft portion $9\times10^3$)

Dye (D-2)

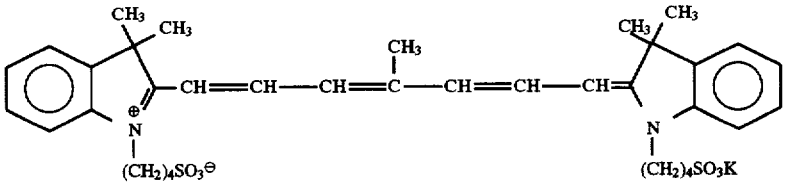

The resulting dispersion was coated on a support for an electrophotographic light-sensitive element (ELP-II Type manufactured by Fuji Photo Film Co., Ltd.) by a wire bar at a coverage of 25 g/m$^2$, set to touch, heated in a circulating oven at 110° C. for 20 seconds and allowed to stand in a dark place under conditions of 30° C. and 80% RH for one week. The adhesive strength of the surface of resulting light-sensitive element was 2 g.f.

Using the light-sensitive element described above, the formation of color duplicate was performed according to the same procedure as in Example 1 except that the formation of toner image was conducted in the following manner. Specifically, the light-sensitive element was charged to −600 V with a corona discharge in a dark place and exposed to light using a semiconductor laser having an oscillation wavelength of 780 nm at an irradiation dose of 25 erg/cm$^2$ on the surface of the light-sensitive element based on an information for yellow color separation of digital image data same as those described in Example 1. The residual potential of the exposed areas was −120 V. Then, the exposed light-sensitive element was subjected to development using a liquid developer prepared by diluting a yellow toner for an electrostatic color plotter (Versareck 3000 manufactured by Xerox Corp.) with 50-fold Isopar G (manufactured by Esso Standard Oil Co.) while a bias voltage of 200 V was applied to an electrode of developing unit to thereby electrodeposit toner particles on the unexposed areas. The light-sensitive element was then rinsed in a bath of Isopar H alone to remove stains in the non-image areas.

The above procedure was repeated using each information for magenta, cyan and black in place of the information for yellow to form color toner images.

In the color duplicate thus-obtained, the toner image was wholly transferred together with the transfer layer onto coated paper. The color duplicate had a sufficient image strength, and retouching and sealing were made thereon same as on plain paper.

EXAMPLES 26 TO 31

An amorphous silicon electrophotographic light-sensitive element (manufactured by KYOSERA Corp.) was installed in an apparatus as shown in FIG. 4. The adhesive strength of the surface thereof was 230 g.f. In order to impart the desired releasability onto the surface of light-sensitive element, the light-sensitive element was brought into contact with a solution containing each of the compounds (S) shown in Table J below dissolved in one liter of Isopar G for 10 seconds while the light-sensitive element was rotated at a circumferential speed of 30 mm/sec, squeezed by a squeezing roll and dried by a heating means 17*a*. As a result, the adhesive strength of the surface of each of the light-sensitive elements thus-treated was in a range of from 3 to 10 g.f. Using each of the light-sensitive elements, the formation of transfer layer, formation of toner image by an electrophotographic process and transfer of toner image together with transfer layer onto high quality paper were performed in the same manner as in Example 2. The color images obtained on high quality paper were clear and free from background stain and had good image strength similar to those in Example 2.

While the invention has been described in detail and with reference to specific embodiments thereof, it will be apparent to one skilled in the art that various changes and modifications can be made therein without departing from the spirit and scope thereof.

What is claimed is:

1. A method of forming a color image by an electrophotographic process comprising forming a peelable transfer layer on a surface of an electrophotographic light-sensitive element, forming a toner image by an electrophotographic process on the transfer layer, heat-transferring the toner image together with the transfer layer onto a receiving material, wherein the transfer layer has a stratified structure

TABLE J

| Example | | Compound (S) | Amount (g/l) |
|---|---|---|---|
| 26 | (S-2) | Mercapto-modified silicone (X-22-167B manufactured by Shin-Etsu Silicone Co., Ltd.) 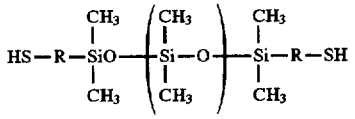 (presumptive structure) | 2 |
| 27 | (S-3) | 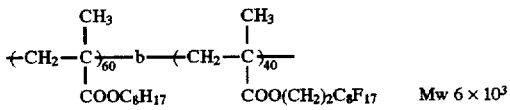 Mw $6 \times 10^3$ | 1.5 |
| 28 | (S-4) | 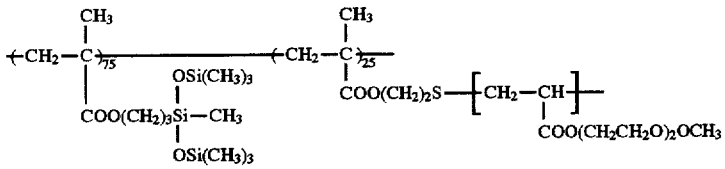 Mw $8 \times 10^3$ (Mw of graft portion $3 \times 10^3$) | 2 |
| 29 | (S-5) | Higher fatty acid-modified silicone (TSF 411 manufactured by Toshiba Silicone Co., Ltd.) 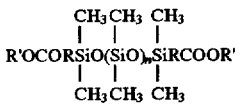 (presumptive structure) | 1 |
| 30 | (S-6) | Carboxy-modified silicone (X-22-3701E manufactured by Shin-Etsu Silicone Co., Ltd.) 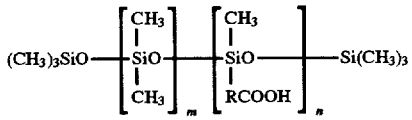 (presumptive structure) | 0.5 |
| 31 | (S-7) | Carbinol-modified silicone (X-22-176B manufactured by Shin-Etsu Silicone Co., Ltd.) 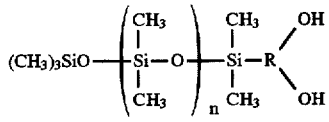 (presumptive structure) | 1 |

composed of a first transfer layer ($T_1$) which is contact with the surface of electrophotographic light-sensitive element and is formed by an electrodeposition coating method using thermoplastic resin grains (AR) each containing a resin (AH) having a glass transition point of from 20° C. to 140° C. or a softening point of from 30° C. to 180° C. and a resin ($AL_1$) having a glass transition point of from −40° C. to 40° C. or a softening point of from 0° C. to 60° C. wherein the glass transition point or softening point of resin (AH) is at least 2° C. higher than that of resin ($AL_1$) and a second transfer layer ($T_2$) provided thereon containing a resin ($AL_2$) having a glass transition point of from −40° C. to 35° C. or a softening point of from 0° C. to 45° C.

2. A method of forming a color image as claimed in claim 1, wherein the surface of electrophotographic light-sensitive element has an adhesive strength of not more than 100 gram.force.

3. A method of forming a color image as claimed in claim 2, wherein the electrophotographic light-sensitive element comprises amorphous silicon as a photoconductive substance.

4. A method of forming a color image as claimed in claim 2, wherein the electrophotographic light-sensitive element contains a polymer having a polymer component containing at least one of a silicon atom and a fluorine atom in the region near to the surface thereof.

5. A method of forming a color image as claimed in claim 4, wherein the polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks.

6. A method of forming a color image as claimed in claim 4, wherein the polymer further contains a polymer component containing a photo- and/or heat-curable group.

7. A method of forming a color image as claimed in claim 5, wherein the polymer further contains a polymer component containing a photo- and/or heat-curable group.

8. A method of forming a color image as claimed in claim 4, wherein the electrophotographic light-sensitive element further contains a photo- and/or heat-curable resin.

9. A method of forming a color image as claimed in claim 1, wherein the electrodeposition coating method comprises supplying the thermoplastic resin grains (AR) as a dispersion thereof in an electrically insulating solvent having an electric resistance of not less than $10^8$ Ω.cm and a dielectric constant of not more than 3.5.

10. A method of forming a color image as claimed in claim 1, wherein the electrodeposition coating method comprising supplying the thermoplastic resin grains (AR) between the electrophotographic light-sensitive element and an electrode placed in face of the light-sensitive element, and migrating the grains by electrophoresis according to a potential gradient applied from an external power source to cause the grains to adhere to or electrodeposit on the electrophotographic light-sensitive element.

11. A method of forming a color image as claimed in claim 4, wherein at least one of the resins (AH) and ($AL_1$) further contains a polymer component (f) containing a moiety having at least one of a fluorine atom and a silicon atom.

12. A method of forming a color image as claimed in claim 11, wherein the polymer components (f) are present as a block in the resin.

13. A method of forming a color image as claimed in claim 1, wherein before the formation of first transfer layer ($T_1$), a compound (S) containing a fluorine atom and/or a silicon atom is applied to the surface of electrophotographic light-sensitive element.

14. A method of forming a color image as claimed in claim 9, wherein the dispersion of thermoplastic resin grains (AR) further contains a compound (S) which contains a fluorine atom and/or a silicon atom.

15. A method of forming a color image as claimed in claim 1, wherein the transfer layer is peelable from the light-sensitive element at a temperature of not more than 180° C. or at a pressure of not more than 30 kgf/cm$^2$.

16. A method of forming a color image as claimed in claim 1, wherein the second transfer layer ($T_2$) is provided by a holt-melt coating method.

17. A method of forming a color image as claimed in claim 1, wherein the second transfer layer ($T_2$) is provided by an electrodeposition coating method.

18. A method of forming a color image as claimed in claim 1, wherein the second transfer layer ($T_2$) is provided by a transfer method from a releasable support.

19. A method of forming a color image as claimed in claim 1, wherein the thermoplastic resin grains (AR) have a core/shell structure.

20. A method of forming a color image as claimed in claim 1, wherein the glass transition point or softening point of the resin ($AL_2$) is at least 2° C. lower than the glass transition point or softening point of the resin (AH).

21. A method of forming a color image as claimed in claim 1, wherein the electrophotographic process comprises a scanning exposure system using a laser beam based on digital information and a development system using a liquid developer.

* * * * *